US011319620B2

(12) United States Patent
Song et al.

(10) Patent No.: US 11,319,620 B2
(45) Date of Patent: May 3, 2022

(54) MARTENSITIC STEELS WITH 1700 TO 2200 MPA TENSILE STRENGTH

(71) Applicant: ArcelorMittal, Luxembourg (LU)

(72) Inventors: Rongjie Song, Chicago, IL (US); Narayan S. Pottore, Munster, IN (US)

(73) Assignee: ArcelorMittal, Luxembourg (LU)

( * ) Notice: Subject to any disclaimer, the term of this patent is extended or adjusted under 35 U.S.C. 154(b) by 0 days.

(21) Appl. No.: 16/570,313

(22) Filed: Sep. 13, 2019

(65) Prior Publication Data

US 2020/0140980 A1 May 7, 2020

Related U.S. Application Data

(63) Continuation of application No. 14/361,270, filed as application No. PCT/US2012/066895 on Nov. 28, 2012, now abandoned.

(Continued)

(51) Int. Cl.

*C22C 38/14* (2006.01)
*C22C 38/04* (2006.01)

(Continued)

(52) U.S. Cl.

CPC ..... *C22C 38/14* (2013.01); *C22C 38/001* (2013.01); *C22C 38/002* (2013.01); *C22C 38/02* (2013.01); *C22C 38/04* (2013.01); *C22C 38/06* (2013.01); *C22C 38/12* (2013.01); *C21D 6/005* (2013.01); *C21D 2211/008* (2013.01)

(58) Field of Classification Search

CPC . C21D 2211/008; C21D 6/005; C22C 38/001; C22C 38/002; C22C 38/02; C22C 38/04; C22C 38/06; C22C 38/12; C22C 38/14

See application file for complete search history.

(56) References Cited

U.S. PATENT DOCUMENTS 5,542,996 A 8/1996 Nagataki et al.
6,284,063 B1 9/2001 Espenhahn et al.

(Continued)

FOREIGN PATENT DOCUMENTS

CN 101363099 A 2/2009
CN 101713046 A 5/2010

(Continued)

OTHER PUBLICATIONS

Carbon and Low-Alloy Steel Sheet and Strip, Properties and Selection: Irons, Steels, and High-Performance Alloys, vol. 1, ASM Handbook, ASM International, 1990, p. 200-211.

*Primary Examiner* — Nicholas A Wang

(74) *Attorney, Agent, or Firm* — Davidson, Davidson & Kappel, LLC

(57) ABSTRACT

A martensitic steel alloy is provided. The martensitic steel alloy includes carbon from 0.22 to 0.36 wt. %, manganese from 0.5% to 2.0% wt. %, and chromium in an amount less than 0.10 wt. %. and a carbon equivalent $C_{eq}$ of less than 0.44 in which $C_{eq}$=C+Mn/6+(Cr+Mo+V)/5+(Ni+Cu)/15. $C_{eq}$ is the carbon equivalent, C, Mn, Cr, Mo, V, Ni, and Cu are in wt. % of the elements in the alloy. The alloy has an ultimate tensile strength of at least 1700 MPa.

12 Claims, 25 Drawing Sheets

Related U.S. Application Data

(60) Provisional application No. 61/629,762, filed on Nov. 28, 2011.

(51) Int. Cl.

| | |
|---|---|
| ***C22C 38/00*** | (2006.01) |
| ***C22C 38/02*** | (2006.01) |
| ***C22C 38/06*** | (2006.01) |
| ***C22C 38/12*** | (2006.01) |
| *C21D 6/00* | (2006.01) |

(56) References Cited

U.S. PATENT DOCUMENTS

| | | | |
|---|---|---|---|
| 8,043,444 | B2 | 10/2011 | Yoshihara |
| 8,449,700 | B2 | 5/2013 | Senuma et al. |
| 8,628,630 | B2 | 1/2014 | Kobayashi et al. |
| 8,691,032 | B2 | 4/2014 | Thomas et al. |
| 10,030,291 | B2 | 7/2018 | Shiraki et al. |
| 2008/0286603 | A1 | 11/2008 | Posco |
| 2011/0287280 | A1 | 11/2011 | Shiraki |
| 2013/0040165 | A1* | 2/2013 | Shiraki ..... C22C 38/50 428/659 |
| 2015/0267281 | A1* | 9/2015 | Song ..... C22C 38/06 420/120 |

FOREIGN PATENT DOCUMENTS

| | | | |
|---|---|---|---|
| CN | 101775545 | A | 7/2010 |
| CN | 102230129 | A | 11/2011 |
| DE | 102008022400 | A1 | 11/2009 |
| EP | 3630983 | A | 12/1994 |
| GB | 2470252 | A | 11/2010 |
| JP | 2006291291 | A | 10/2006 |
| JP | 2009263876 | A | 11/2009 |
| JP | 2010070806 | A | 4/2010 |
| JP | 2010248565 | A | 11/2010 |
| JP | 2011063877 | A | 3/2011 |
| JP | 2011518669 | A | 6/2011 |
| JP | 2011202195 | A | 10/2011 |
| JP | 2013036112 | A | 2/2013 |
| KR | 100878614 | B1 | 1/2009 |
| KR | 20090124263 | * | 12/2009 |
| KR | 20090124263 | A | 12/2009 |
| RU | 2238332 | C1 | 10/2004 |
| WO | 2011118459 | A1 | 9/2011 |

* cited by examiner

Experimental steel

Experimental steel

Experimental steel

Experimental steel

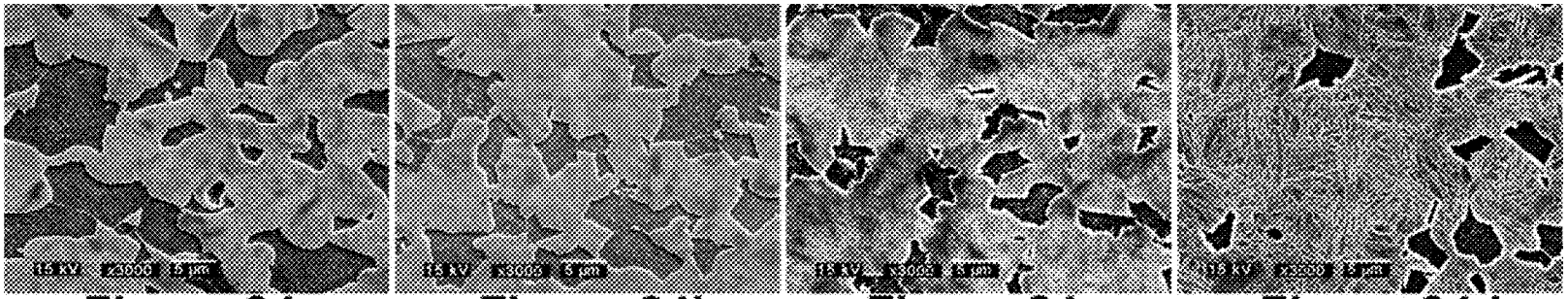
Figure 24a
Figure 24b
Figure 24c
Figure 24d
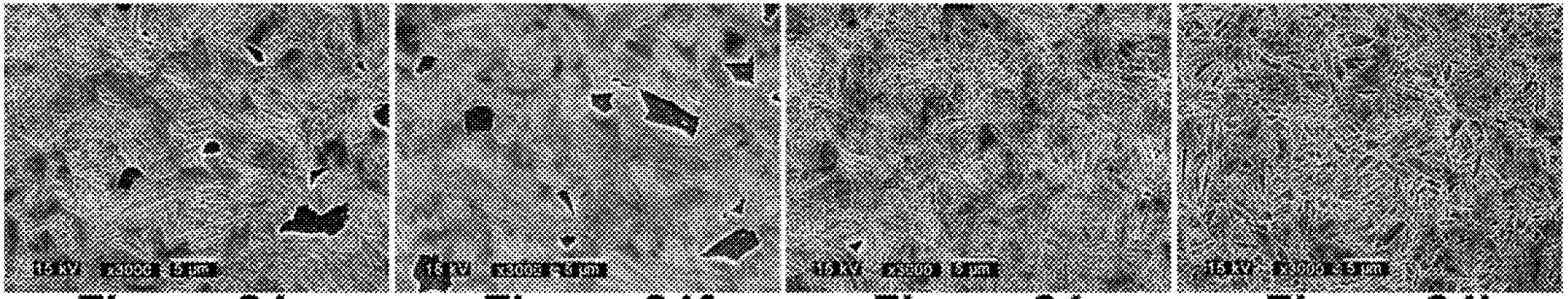
Figure 24e
Figure 24f
Figure 24g
Figure 24h
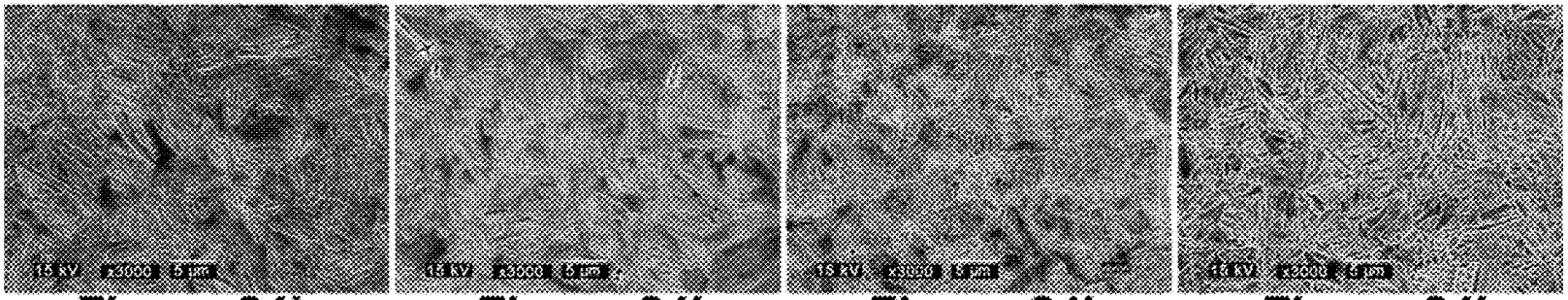
Figure 24i
Figure 24j
Figure 24k
Figure 24l

MARTENSITIC STEELS WITH 1700 TO 2200 MPA TENSILE STRENGTH

CROSS-REFERENCE TO RELATED APPLICATIONS

This is a Continuation of U.S. Ser. No. 14/361,270, filed May 28, 2014 which is a National Stage of International Patent Application PCT/US2012/066895, filed Nov. 28, 2012 which claims the benefit under 35 U.S.C. § 119(e) of U.S. Provisional Application No. 61/629,762 filed Nov. 28, 2011, the entire disclosures of which are hereby incorporated by reference herein.

FIELD OF THE INVENTION

The present invention relates to martensitic steel compositions and methods of production thereof. More specifically, the martensitic steels have tensile strengths ranging from 1700 to 2200 MPa. Most specifically, the invention relates to thin gage (thickness of ≤1 mm) ultra high strength steel with an ultimate tensile strength of 1700-2200 MPa and methods of production thereof.

BACKGROUND OF THE INVENTION

Low-carbon steels with martensitic microstructure constitute a class of Advanced High Strength Steels (AHSS) with the highest strengths attainable in sheet steels. By varying the carbon content in the steel, ArcelorMittal has been producing martensitic steels with tensile strength ranging from 900 to 1500 MPa for two decades. Martensitic steels are increasingly being used in applications that require high strength for side impact and roll over vehicle protection, and have long been used for applications such as bumpers that can readily be rolled formed.

Currently, thin gage (thickness of ≤1 mm) ultra high strength steel with ultimate tensile strength of 1700-2200 MPa with good roll formability, weldability, punchability and delayed fracture resistance is in demand for the manufacture of hang on automotive parts such as bumper beams. Light gauge, high strength steels are required to fend off competitive challenges from alternative materials, such as lightweight 7xxx series of aluminum alloys. Carbon content has been the most important factor in determining the ultimate tensile strength of martensitic steels. The steel has to have sufficient hardenability so as to fully transform to martensite when quenched from a supercritical annealing temperature.

SUMMARY OF THE INVENTION

The present invention comprises a martensitic steel alloy that has an ultimate tensile strength of at least 1700 MPa. Preferably, the alloy may have an ultimate tensile strength of at least 1800 MPa, at least 1900 MPa, at least 2000 MPa or even at least 2100 MPa. The martensitic steel alloy may have an ultimate tensile strength between 1700 and 2200 MPa. The martensitic steel alloy may have a total elongation of at least 3.5% and more preferably at least 5%.

The martensitic steel alloy may be in the form of a cold rolled sheet, band or coil and may have a thickness of less than or equal to 1 mm. The martensitic steel alloy may have a carbon equivalent of less than 0.44 using the formula $Ceq=C+Mn/6+(Cr+Mo+V)/5+(Ni+Cu)/15$, where Ceq is the carbon equivalent, and C, Mn, Cr, Mo, V, Ni, and Cu are in wt. % of the elements in the alloy.

The martensitic steel alloy may contain between 0.22 and 0.36 wt. % carbon. More specifically, the alloy may contain between 0.22 and 0.28 wt. % carbon or in the alternative the alloy may contain between 0.28 and 0.36 wt. % carbon. The martensitic steel alloy may further contain between 0.5 and 2.0 wt. % manganese. The alloy may also contain about 0.2 wt. % silicon. The optionally may contain one or more of Nb, Ti, B, Al, N, S, P.

BRIEF DESCRIPTION OF THE DRAWINGS

A preferred embodiment of the present invention will be elucidated with references to the drawings in which:

(FIGS. 8*a* and 8*b* show varied C, 8*c* and 8*d* show varied Mn and 8*e* and 8*f* show varied Nb) on the tensile properties of steels of the present invention;

(FIGS. 9*a* and 9*b* show varied C, 9*c* and 9*d* show varied Mn and 9*e* and 9*f* show varied Nb) on tensile properties of additional steels of the present invention;

FIGS. 24*a* to 24*l* are micrographs of four alloys which were annealed using various soak/quenching temperature pairs.

DETAILED DESCRIPTION OF THE INVENTION

Figure 1B:
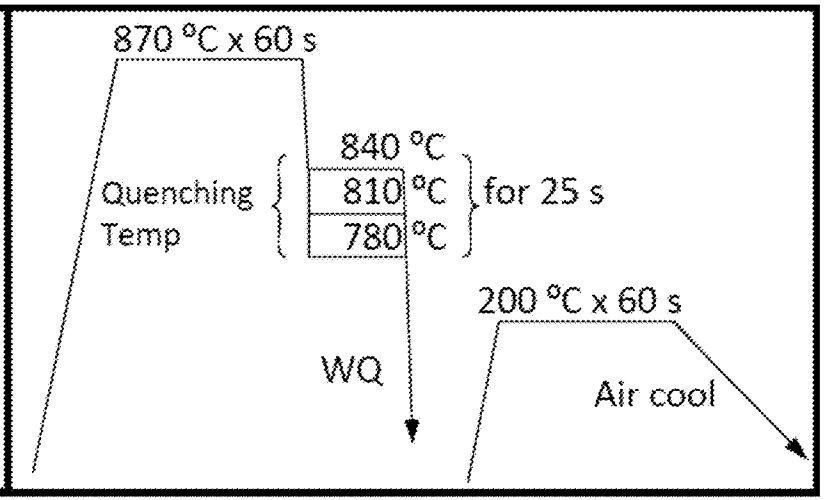
FIGS. 1*a* and 1*b* are schematic illustrations of annealing procedures for producing the alloys of the present invention.

The present invention provides a family of martensitic steels with tensile strength ranging from 1700 to 2200 MPa. The steel may be thin gauge (thickness of less than or equal to 1 mm) sheet steel. The present invention also includes the process for producing the very high tensile strength martensitic steels. Examples and embodiments of the present invention are presented below.

Example 1

Materials and Experimental Procedures

Table 1 shows the chemical compositions of some steels within the present invention, which includes a range of carbon content from 0.22 to 0.28 wt % (steels 2, 4 and 5), manganese content from 1.5 to 2.0 wt % (steels 1 and 3) and niobium content from 0 to 0.02 wt % (alloys 2 and 3). The remainder of the steel composition is iron and inevitable impurities.

TABLE 1

| ID | Steel | C | Mn | Si | Nb | Al | N | S | P |
|---|---|---|---|---|---|---|---|---|---|
| 1 | 0.22C—1.5Mn—0.018Nb | 0.22 | 1.48 | 0.198 | 0.019 | 0.036 | 0.0043 | 0.002 | 0.006 |
| 2 | 0.22C—2.0Mn | 0.22 | 2.00 | 0.199 | — | 0.027 | 0.0049 | 0.002 | 0.006 |
| 3 | 0.22C—2.0Mn—0.018Nb | 0.22 | 2.00 | 0.197 | 0.018 | 0.033 | 0.0045 | 0.002 | 0.006 |
| 4 | 0.25C—2.0Mn | 0.25 | 1.99 | 0.201 | — | 0.025 | 0.005 | 0.003 | 0.009 |
| 5 | 0.28C—2.0Mn | 0.28 | 2.01 | 0.202 | — | 0.032 | 0.0045 | 0.003 | 0.007 |

Five 45 Kg slabs were cast in the laboratory. After reheating and austenitization at 1230° C. for 3 hours, the slabs were hot rolled from 63 mm to 20 mm in thickness on a laboratory mill. The finishing temperature was about 900° C. The plates were air cooled after hot rolling.

After shearing and reheating the pre-rolled 20 mm thick plates to 1230° C. for 2 hours, the plates were hot rolled from a thickness of 20 mm to 3.5 mm. The finish rolling temperature was about 900° C. After controlled cooling at an average cooling rate of about 45° C./s, the hot bands of each composition were held in a furnace at 580° C. for 1 hour, followed by a 24-hour furnace cooling to simulate the industrial coiling process.

Three JIS-T standard specimens were prepared from each hot band for room temperature tensile test. Microstructure characterization of hot bands was carried out by Scanning Electron Microscopy (SEM) at the quarter thickness location in the longitudinal cross-sections.

Both surfaces of the hot rolled bands were ground to remove any decarburized layer. They were then subjected to 75% lab cold rolling to obtain full hard steels with final thickness of 0.6 mm for further annealing simulations.

Figure 1A:
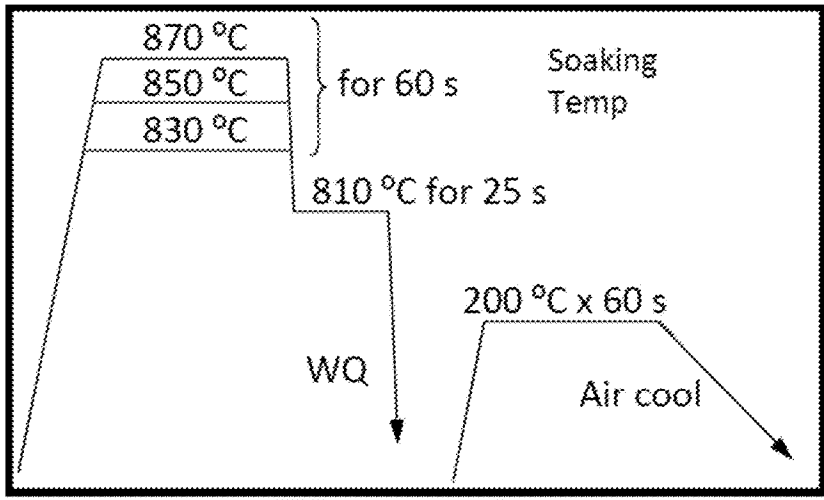

Annealing simulation was performed using two salt pots and one oil bath. The effects of soaking and quenching temperatures were analyzed for all of the steels. A schematic illustration of the heat treatment is shown in FIGS. 1(*a*) and 1(*b*). FIG. 1(*a*) illustrates the annealing processes with different soaking temperatures from 830° C. to 870° C. FIG. 1(*b*) illustrates the annealing processes with different quenching temperatures from 780° C. to 840° C.

To study the effect of soaking temperature, the annealing process included reheating the cold rolled strips (0.6 mm thick) to 870° C., 850° C. and 830° C. respectively followed by isothermal holding for 60 seconds. The samples were immediately transferred to the second salt pot maintained at a temperature of 810° C. and isothermally held for 25 s. This was followed by a water quench. The samples were then reheated to 200° C. for 60 s in an oil bath, followed by air cooling to room temperature to simulate overage treatment. The holding times at soaking, quenching and overaging temperatures were chosen to closely approximate industrial conditions for this gauge.

To study the effect of quenching temperature, the analysis includes reheating of cold rolled strips to 870° C. for 60 seconds, followed by immediate cooling to 840° C., 810° C. and 780° C. After a 25 second isothermal hold at the quenching temperature, the specimens were quenched in water. The steels were then reheated to 200° C. for 60 seconds followed by air cooling to simulate the overage treatment. Three ASTM-T standard specimens were prepared from each annealed blank for tensile testing at room temperature.

The samples processed at 870° C. soaking temperature and quenched from 810° C. were selected for bend testing. A 90° free V-bend with the bending axis in the rolling direction was employed for bendability characterization. A dedicated Instron mechanical testing system with 90° die block and punches was utilized for this test. A series of interchangeable punches with different die radius facilitated the determination of minimum die radius at which the samples could be bent without microcracks. The test was run at a constant stroke of 15 mm/sec until the sample was bent by 90°. A 80 KN force and 5 second dwell time was deployed at the maximum bend angle after which the load was released and the specimen was allowed to spring back. In the present test, the range of die radius varied from 1.75 to 2.75 mm with 0.25 mm incremental increase. The sample surface after bend testing was observed under 10× magnification. A crack length on the sample bending surface that is smaller than 0.5 mm is considered to be a "micro crack", and any that is larger than 0.5 mm is recognized as a crack and the test marked as a failure. Samples with no visible crack are identified as "passed test".

Microstructure and Tensile Properties of Hot Rolled Bands

Figure 2A:
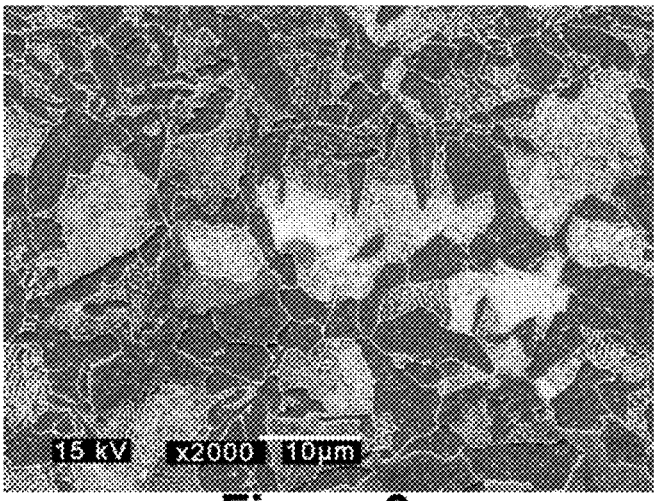
FIGS. 2*a*, 2*b* and 2*c* are SEM micrographs of experimental steels with 2.0% Mn-0.2% Si and various carbon contents (2*a* has 0.22% C; 2*b* has 0.25% C; and 2*c* has 0.28% C) after hot rolling and simulated coiling at 580° C.
Figure 2B:
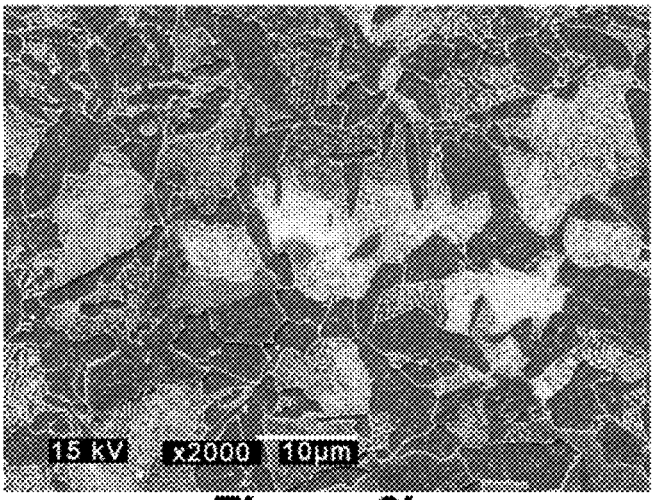
Figure 2C:
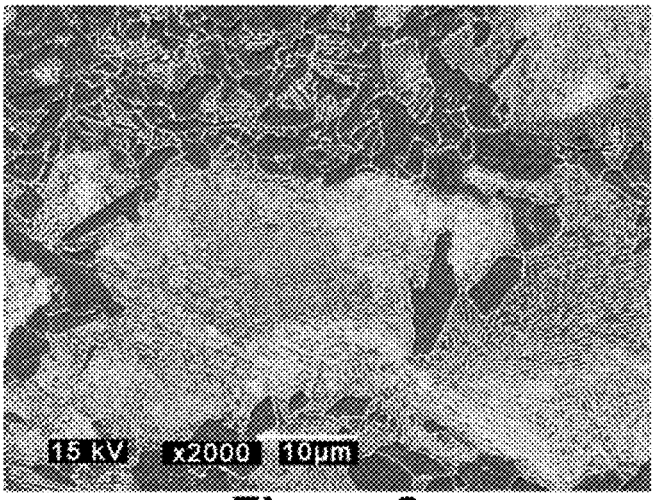

Effect of Composition on Microstructure and Tensile Properties of Hot Rolled Steels FIGS. 2*a*, 2*b* and 2*c* are SEM micrographs of experimental steels with 2.0% Mn-0.2% Si and various carbon contents (2*a* has 0.22% C; 2*b* has 0.25% C; and 2*c* has 0.28% C) after hot rolling and simulated coiling at 580° C.

Figure 3:
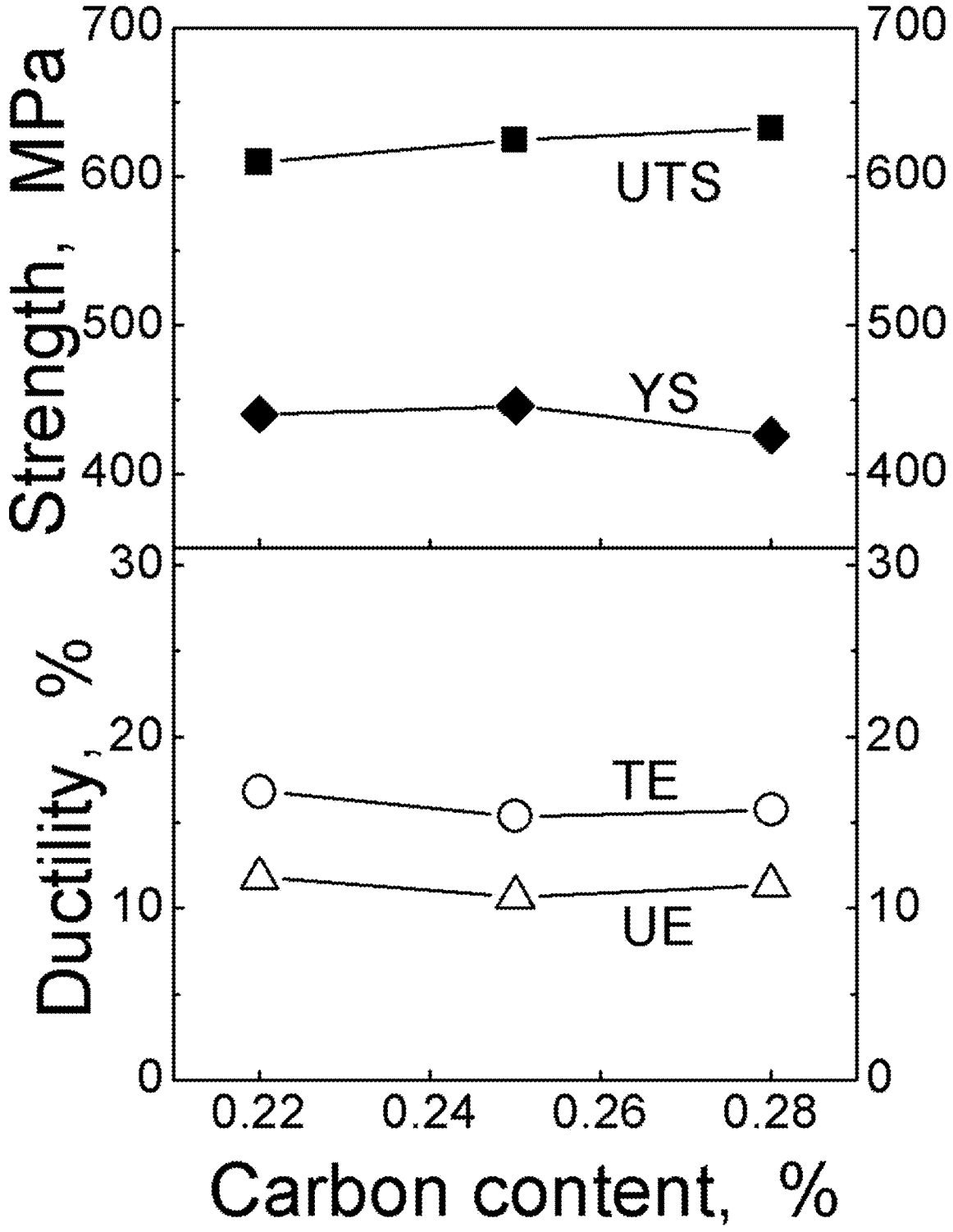
FIG. 3 is a plot of the tensile properties at room temperature of experimental steel hot bands useful in producing alloys of the present invention.

The increase in carbon content resulted in an increase in the volume fraction and the colony size of pearlite. The corresponding tensile properties at room temperature of the experimental steels are plotted in FIG. 3, where strength in MPa (top half of the graph) and ductility in percentage (bottom half of the graph) are plotted against carbon content. In FIG. 3 and herein, UTS means ultimate tensile strength, YS means yield strength, TE means total elongation, UE means uniform elongation. As shown, the increase in carbon content from 0.22 to 0.28% led to a slight increase in ultimate tensile strength from 609 to 632 MPa, a slight decrease in yield strength from 440 to 426 MPa but little change in ductility (average TE and UE are about 16% and 11% respectively).

Figure 4A:
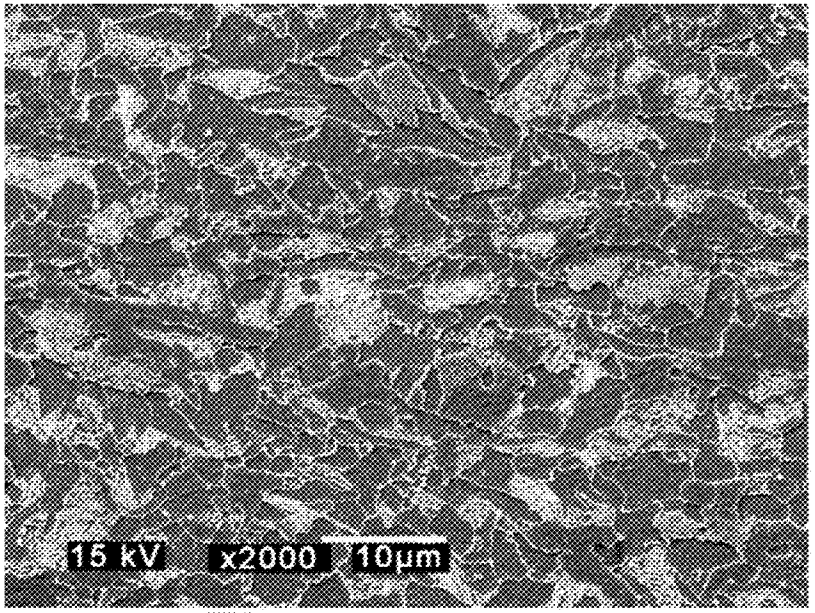
FIGS. 4*a* and 4*b* are SEM micrographs of experimental steels with 0.22% C-0.2% Si-0.02% Nb and two different Mn contents (4*a* has 1.48% and 4*b* has 2.0%) after hot rolling and simulated coiling at 580° C.
Figure 4B:
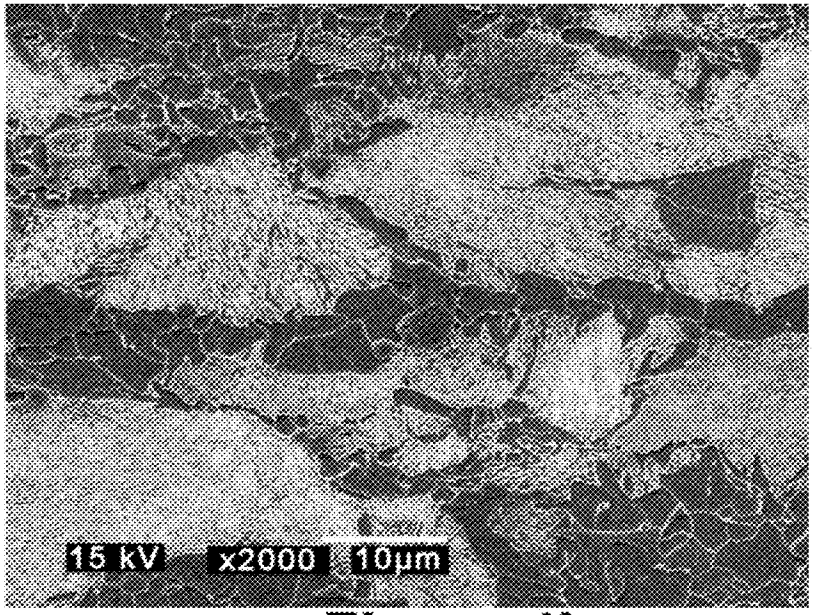

FIGS. 4*a* and 4*b* are SEM micrographs of experimental steels with 0.22% C-0.2% Si-0.02% Nb and two different Mn contents (4*a* has 1.48% and 4*b* has 2.0%) after hot rolling and simulated coiling at 580° C. An increase in the Mn content resulted in an increase in the volume fraction and in size of pearlite colony. The large grain size in the higher Mn steel can be attributed to grain coarsening during finish rolling and subsequent cooling. The hot rolling finish temperature was about 900° C., which is in the austenite region for both of the experimental steels but it is much higher than the $Ar_3$ temperature for the higher Mn steel. Thus, during and after finish rolling, the austenite in the higher Mn steel had a greater opportunity to coarsen, resulting in a coarser ferrite-pearlite microstructure after phase transformation.

Figure 5:
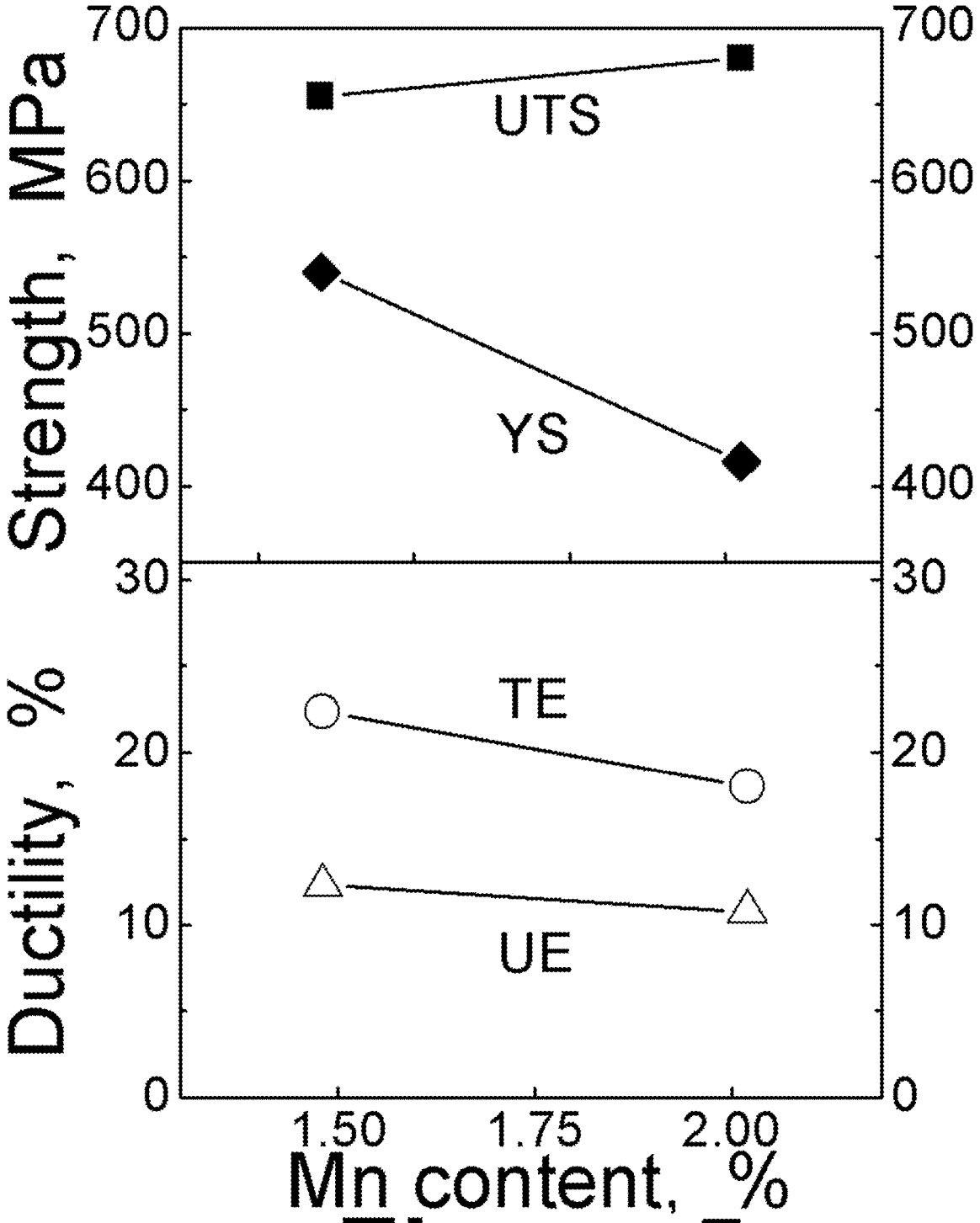
FIG. 5 is a plot of the tensile properties at room temperature of another experimental steel hot bands for producing alloys of the present invention.

The corresponding tensile properties of the experimental steels with 0.22% C-2.0% Mn at room temperature are plotted in FIG. 5, where strength in MPa (top half of the graph) and ductility in percentage (bottom half of the graph) are plotted against manganese content. As shown, an increase in the Mn content from 1.48 to 2.0% led to a small increase in the ultimate tensile strength from 655 to 680 MPa, a marked decrease in yield strength from 540 to 416 MPa and a slight decrease in ductility from 22 to 18% for TE and from 12 to 11% for UE. The corresponding yield ratio (YR) dropped from 0.8 to 0.6 and yield point elongation (YPE) decreased from 3.1 to 0.3% with the increase in Mn content. The tremendous decrease in YS, YR and YPE in spite of solid solution strengthening by Mn may be attributed to the formation of martensite in the higher Mn steel. A small amount of martensite (even less than 5%) can create free dislocations surrounding ferrite to facilitate initial plastic deformation, as is well known for DP steels. In addition, higher hardenability of the higher Mn steel may also result in coarse austenite grain size.

Figure 6A:
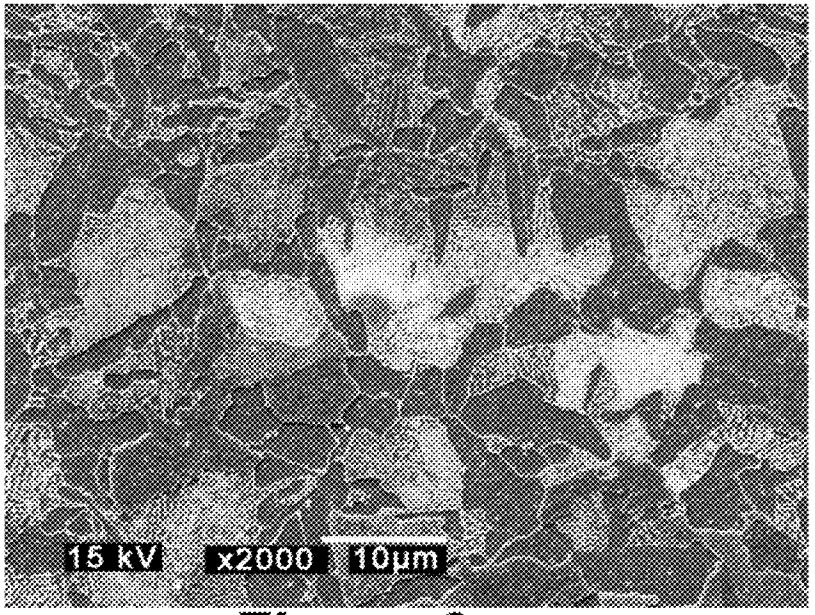
FIGS. 6*a* and 6*b* are SEM micrographs of experimental steels with 0.22% C-2.0% Mn-0.2% Si and different Nb contents (6*a* has 0% and 6*b* has 0.018%) after hot rolling and simulated coiling at 580° C.
Figure 6B:
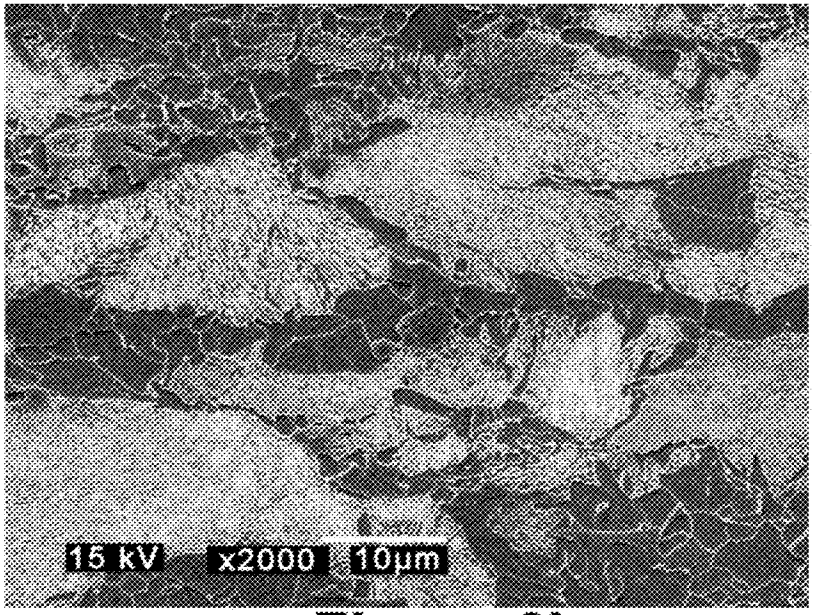

FIGS. 6*a* and 6*b* are SEM micrographs of experimental steels with 0.22% C-2.0% Mn-0.2% Si and different Nb contents (6*a* has 0%/a and 6*b* has 0.018%) after hot rolling and simulated coiling at 580° C. An increase in the Nb content resulted in an increase in the volume fraction and colony size of pearlite, which can be explained by higher hardenability of the steel with Nb and lower temperature of pearlite formation.

Figure 7:
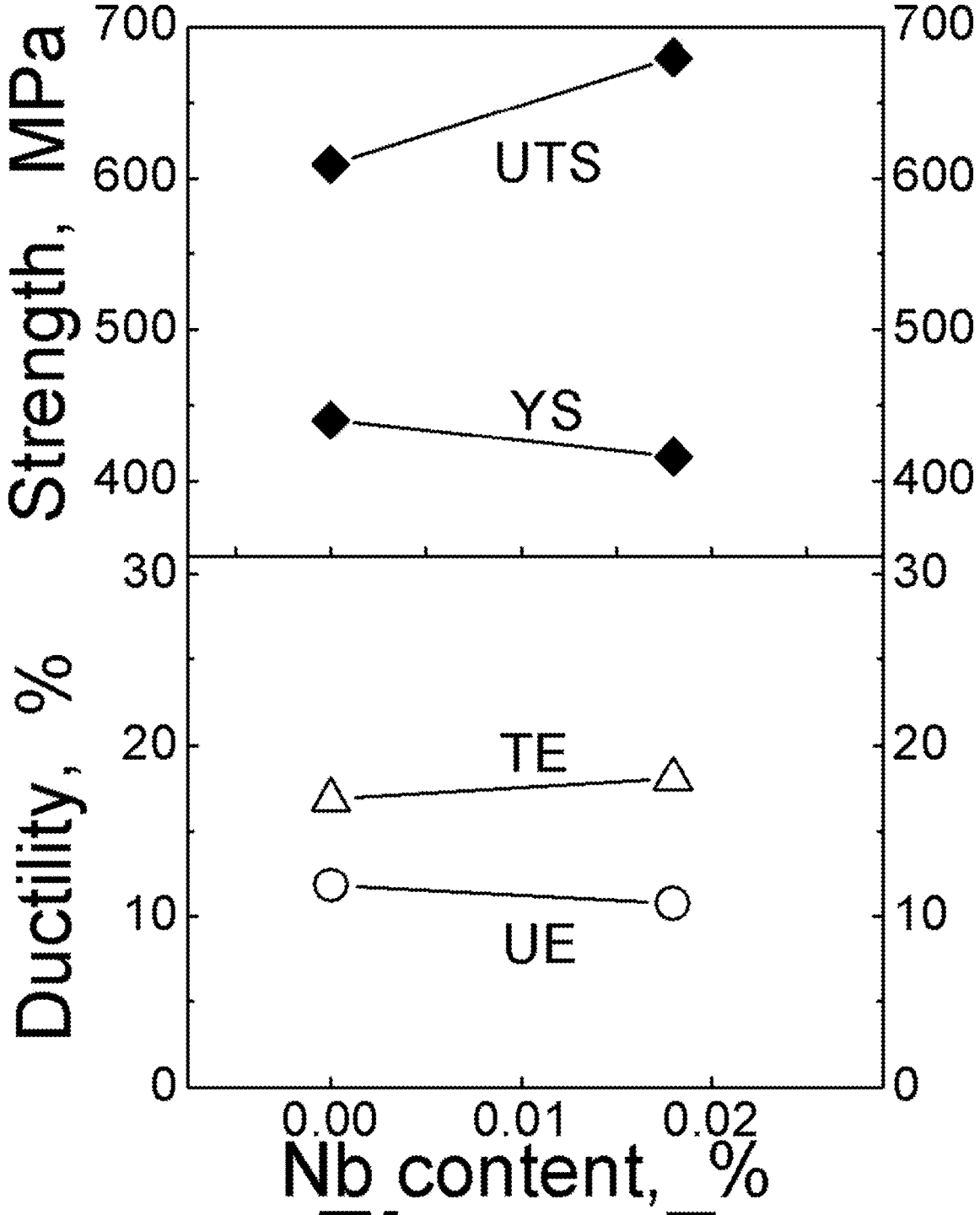
FIG. 7 is a plot of the tensile properties at room temperature of yet another experimental steel hot bands for producing alloys of the present invention.

The corresponding tensile properties of the compared steels with 0.22% C-2.0% Mn are illustrated in FIG. 7, where strength in MPa (top half of the graph) and ductility in percentage (bottom half of the graph) are plotted against niobium content. As shown, the addition of 0.018% Nb led to an increase in the ultimate tensile strength (UTS) from 609 to 680 MPa, a small decrease in yield strength (YS) from 440 to 416 MPa and a slight increase in average TE from 16.8 to 18.0% with UE decreasing from 11.8 to 10.8%. The corresponding yield ratio (YR) dropped from 0.72 to 0.61 and yield point elongation (YPE) decreased from 2.3 to 0.3% with the increase in Nb content.

Figure 8A:
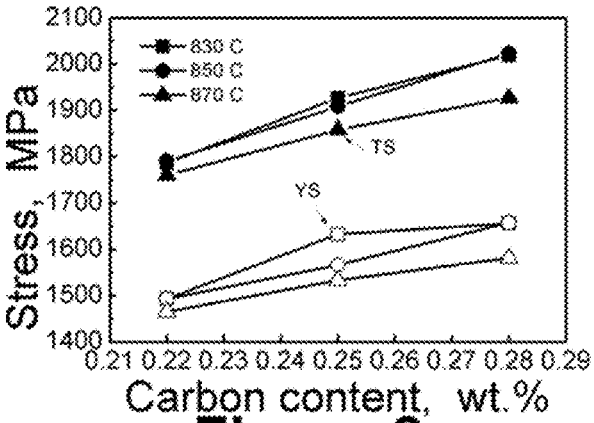
FIGS. 8*a* to 8*f* illustrate the effects of soaking temperature (830, 850 and 870° C.) and steel composition
Figure 8B:
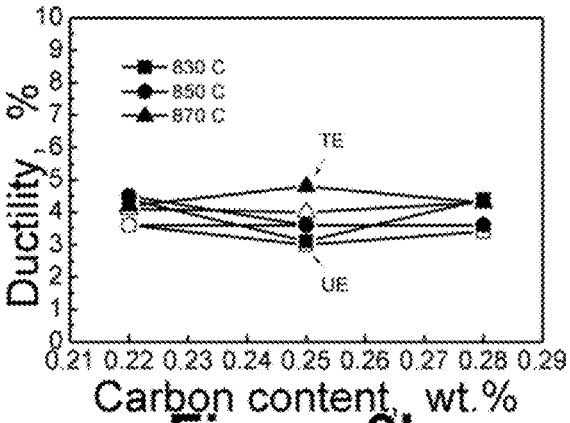
Figure 8C:
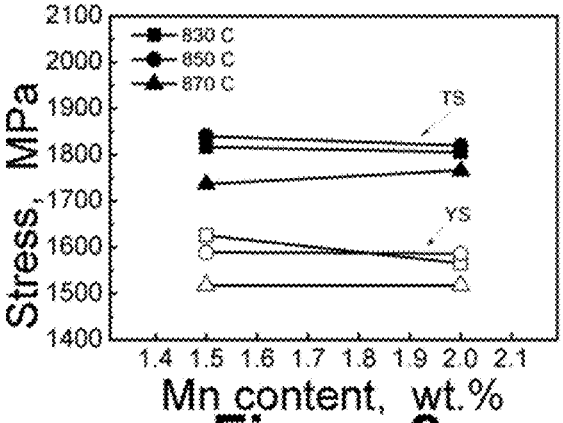
Figure 8D:
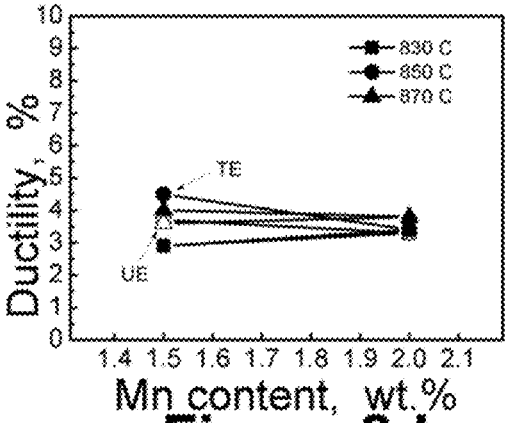
Figure 8E:
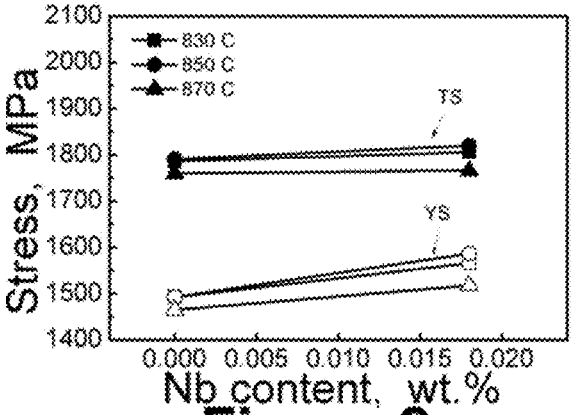
Figure 8F:
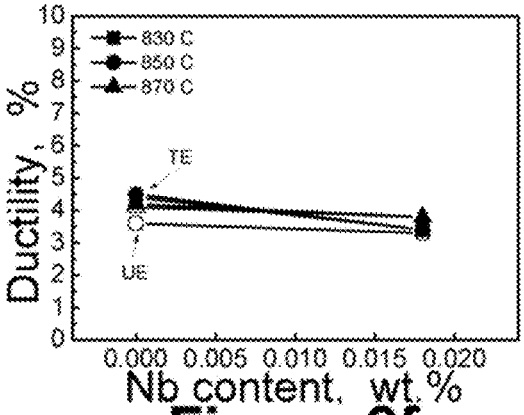

Tensile Properties of the Investigated Steels after Cold Rolling and Annealing Simulation FIGS. 8*a* to 8*f* illustrate the effects of soaking temperature (830, 850 and 870° C.) and steel composition (FIGS. 8*a* and 8*b* show varied C, 8*c* and 8*d* show varied Mn and 8*e* and 8*f* show varied Nb) on the tensile properties of steels. The decrease in soaking temperature from 870 to 850° C. resulted in an increase of 28-76 MPa in yield strength (YS) and 30-103 MPa in ultimate tensile strength (UTS), which may be attributed to the smaller grain size at lower soaking temperature. A further decrease in soaking temperature from 850 to 830° C. did not lead to a significant change in UTS. There is no effect of soaking temperature on ductility and the uniform/total elongation ranges from 3 to 4.75% in all the experimental steels. It should be stressed that UTS exceeding 2000 MPa and uniform/total elongation of ~3.5-4.5% were achieved in the steel with 0.28% C-2.0% Mn-0.2% Si (see FIGS. 8*a*-8*b*).

Figure 9A:
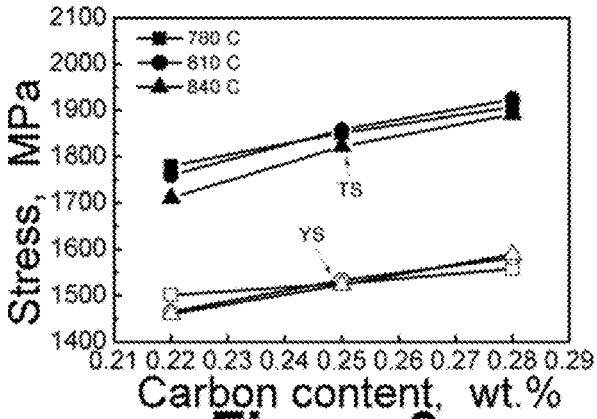
FIGS. 9*a* to 9*f* show the effects of quenching temperature (780, 810 and 840° C.) and steel composition
Figure 9B:
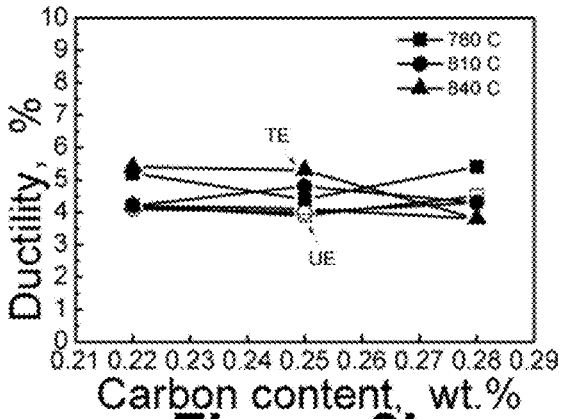
Figure 9C:
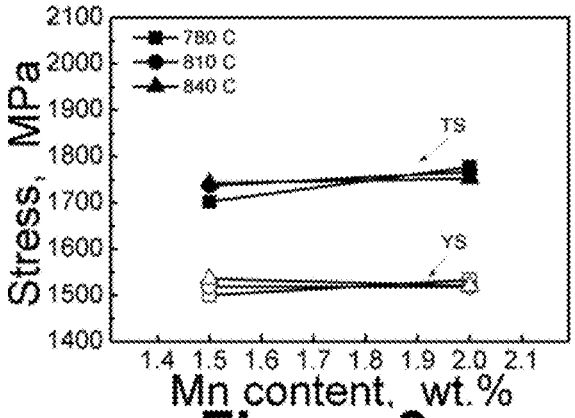
Figure 9D:
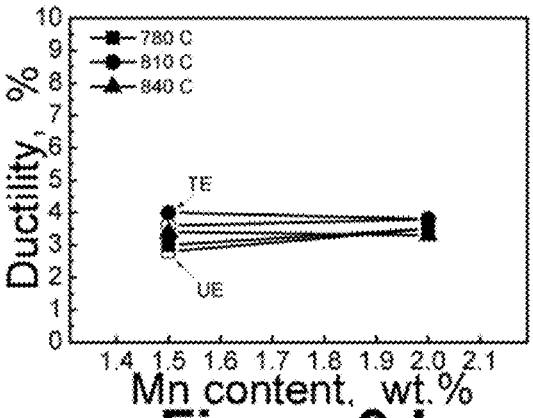
Figure 9E:
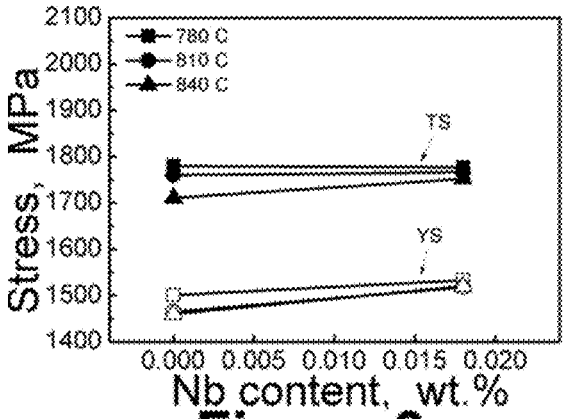
Figure 9F:
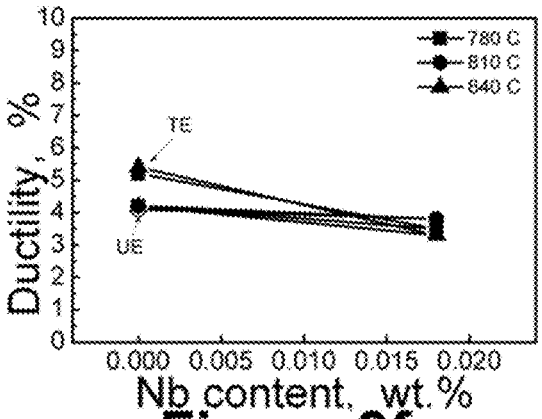

FIGS. 9*a* to 9*f* show the effects of quenching temperature (780, 810 and 840° C.) and steel composition (FIGS. 9*a* and 9*b* show varied C, 9*c* and 9*d* show varied Mn and 9*e* and 9*f* show varied Nb) on tensile properties of the investigated steels. There is no significant effect of quenching temperature on strength and ductility when 100% martensite is obtained. The uniform/total elongation ranges from 2.75 to 5.5% in all the experimental steels. The data suggests that a wide process window is feasible during anneal.

FIGS. 8*a*, 8*b*, 9*a*, and 9*b* show that an increase in the C content resulted in a significant increase in tensile strength but had little effect on ductility. Taking the annealing cycle of 830° C. (soaking temperature)-810° C. (quenching temperature) as an example, the increase in YS and UTS is 163 and 233 MPa, respectively, when C content is increased from 0.22 to 0.28 wt %. The increase in Mn content from 1.5 to 2.0 wt % has barely any effect on strength and ductility (see FIGS. 8*c*, 8*d*, 9*c* and 9*d*). The addition of Nb (about 0.02 wt %) led to an increase in YS up to 94 MPa with almost no effect on UTS but a decrease in total elongation of 2.4% (see FIGS. 8*e*, 8*f*, 9*e* and 9*f*).

Bendability of the Investigated Steels

Table 2 summarizes the effects of C, Mn and Nb on tensile properties and bendability of the experimental steels after 75% cold rolling and annealing. The annealing cycle included: heating the cold rolled bands (about 0.6 mm thick) to 870° C., isothermal hold for 60 seconds at soaking temperature, immediate cooling to 810° C., 25 seconds isothermal holding at that temperature, followed by rapid water quench. The panels were then reheated to 200° C. in an oil bath and held for 60 seconds, followed by air cooling to simulate overage treatment. The data shows that carbon has the strongest effect on strength and a slight effect on bendability. The addition of Nb increases yield strength and improves bendability. The improvement in bendability is achieved in spite of marginally inferior elongation. An increase in the Mn content from 1.5 to 2.0% in the Nb bearing steel has no significant effect on tensile properties but results in a big improvement in bendability.

average cooling rate of about 45° C./s, the hot bands of each composition were held in a furnace at 580° C. and 660 OC respectively for 1 hour, followed by a 24-hour furnace cooling to simulate the industrial coiling process. The use of two different coiling temperatures was designed to understand the available process window during hot rolling for the manufacture of this product.

A recheck of hot band compositions was performed by inductively coupled plasma (ICP). In comparison with ingot derived data, a carbon loss is generally observed in the hot bands. Three JIS-T standard specimens were prepared from each hot band for room temperature tensile tests. Microstructure characterization of hot bands was carried out by Scanning Electron Microscopy (SEM) at the quarter thickness location of longitudinal cross-sections.

Cold Rolling

After grinding both surfaces of the hot rolled bands to remove any decarburized layer, the steels were cold rolled in

TABLE 2

| Steel | $T_{soak}$ ° C. | $T_{GJC}$ ° C. | $T_{O\backslash}$ ° C. | Gauge mm | YS MPa | TS MPa | YS/TS | UE % | TE % | YPE % | Bendability pass | Bendability micro crack < 0.5 mm |
|---|---|---|---|---|---|---|---|---|---|---|---|---|
| 0.22C—1.5Mn—0.018Nb | 870 | 810 | 200 | 0.69 | 1518 | 1737 | 0.87 | 3.6 | 4 | 0 | 4.0t | 2.9t |
| 0.22C—2.0Mn—0.018Nb | 870 | 810 | 200 | 0.69 | 1518 | 1766 | 0.86 | 3.8 | 3.7 | 0 | 2.9t | 2.5t |
| 0.22C—2.0Mn | 870 | 810 | 200 | 0.66 | 1465 | 1760 | 0.83 | 4.1 | 4.2 | 0 | 3.7t | 2.2t |
| 0.25C—2.0Mn | 870 | 810 | 200 | 0.68 | 1533 | 1858 | 0.83 | 4 | 4.8 | 0 | 3.7t | 2.6t |
| 0.28C—2.0Mn | 870 | 810 | 200 | 0.68 | 1581 | 1927 | 0.82 | 4.3 | 4.2 | 0 | 4.0t | 3.2t |

Example 2

In order to reduce carbon equivalent, thus to improve the weldability of the steels of Example 1, steels containing 0.28 wt % carbon and reduced manganese content (about 1.0 wt % vs. 2.0 wt % of Example 1) along with were produced. The alloys were cast into slabs, hot rolled, cold rolled, annealed (simulated) and over age treated. In addition, the effect of Mn content (1.0 and 2.0% Mn) on the properties of hot rolled bands and annealed products are described in detail.

Heat Preparation

Table 3 shows the chemical compositions of investigated steels. The alloy design analyzed the effects of incorporated Ti (steels 1 and 2), B (steels 2 and 3) and Nb (alloys 3 and 4).

the laboratory by 50% to obtain full hard steels with final thickness of 1.0 mm for further annealing simulations.

Annealing Simulation

Figures 10A, 10B:
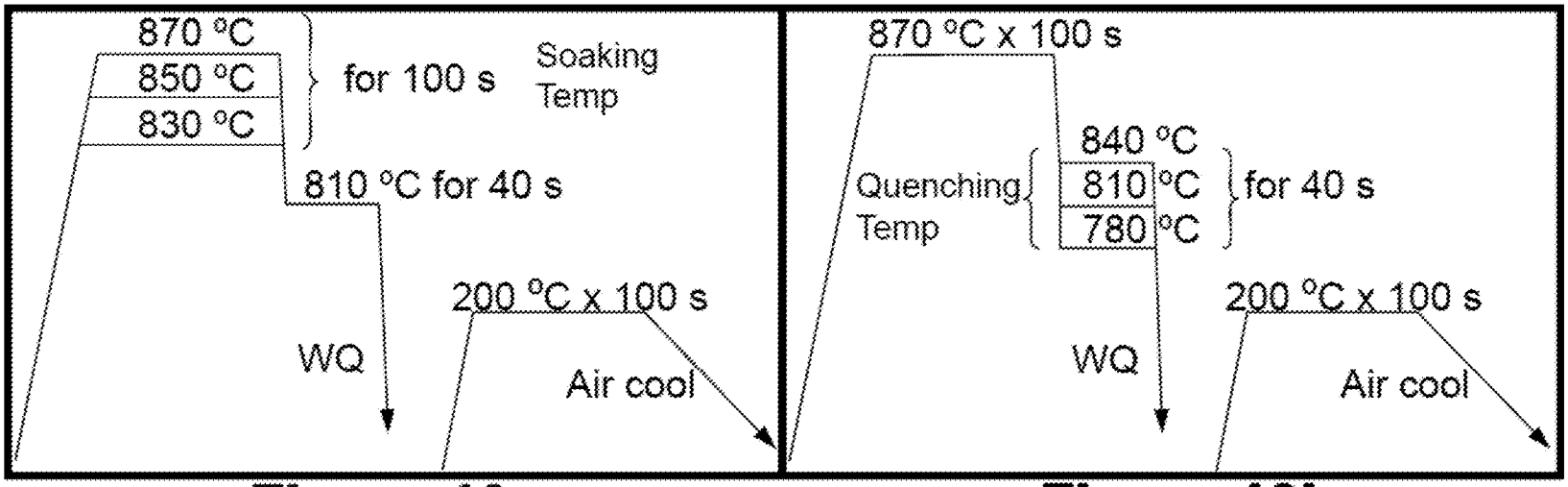
FIGS. 10*a* and 10*b* are schematic depictions of the additional anneal cycles for producing alloys of the present invention.

The effects of soaking and quenching temperatures during annealing on the mechanical properties of the steels were investigated for all of the experimental steels. A schematic of the anneal cycles is shown in FIGS. 10*a* and 10*b*. FIG. 10*a* illustrates the annealing processes with different soaking temperatures from 830° C. to 870° C. FIG. 10*b* illustrates the annealing processes with different quenching temperatures from 780° C. to 840° C.

The annealing process includes reheating the cold band (about 1.0 mm thick) to 870° C., 850° C. and 830° C. for 100 s, respectively, to investigate the effect of soaking temperature on final properties. After immediate cooling to 810° C. and isothermal holding for 40 s, water quench was applied.

TABLE 3

| ID | Steel | C | Mn | Si | S | P | N | Al | Ti | B | Nb |
|---|---|---|---|---|---|---|---|---|---|---|---|
| 1 | Base | 0.28 | 0.98 | 0.204 | 0.003 | 0.007 | 0.0049 | 0.035 | | | |
| 2 | Base-Ti | 0.28 | 0.98 | 0.198 | 0.003 | 0.005 | 0.0047 | 0.04 | 0.024 | | |
| 3 | Base-Ti—B | 0.28 | 0.98 | 0.204 | 0.003 | 0.005 | 0.0047 | 0.04 | 0.024 | 0.0018 | |
| 4 | Base-Ti—B—Nb | 0.28 | 0.97 | 0.202 | 0.003 | 0.006 | 0.0048 | 0.037 | 0.024 | 0.0017 | 0.029 |

Four 45 Kg slabs (one of each alloy) were cast in the laboratory. After reheating and austenitization at 1230° C. for 3 hours, the slabs were hot rolled from 63 mm to 20 mm in thickness on a laboratory mill. The finishing temperature was about 900° C. The plates were air cooled after hot rolling.

Hot Rolling and Microstructure/Tensile Property Investigation

After shearing and reheating the pre-rolled 20 mm thick plates to 1230° C. for 2 hours, the plates were hot rolled from a thickness of 20 mm to 3.5 mm. The finish rolling temperature was about 900° C. After controlled cooling at an The steels were then reheated to 200° C. for 100 s, and followed by air cooling to simulate overaging treatment.

The annealing process includes reheating the cold band to 870° C. for 100 s and immediate cooling to 840° C., 810° C. and 780° C. respectively to investigate the effect of quenching temperature on the mechanical properties of the steels. Water quench was employed after 40 s isothermal hold at the quenching temperature. The steels were then reheated to 200° C. for 100 s, and followed by air cooling to simulate the overaging treatment.

Tensile Property and Bendability of Annealed Steels

Three ASTM-T standard tensile specimens were prepared from each annealed band for room temperature tensile test.

Samples processed by one annealing cycle were selected for bend testing. This annealing cycle involved the reheating of the cold band (about 1.0 mm thick) to 850° C. for 100 s, immediate cooling to 810° C., 40 s isothermal hold at quench temperature, followed by water quench. The steels were then reheated to 200° C. for 100 s, and followed by air cooling to simulate the overaging treatment. A 90° free V-bend testing along the rolling direction was employed for bendability characterization. In the present study, the range of die radius varied from 2.75 to 4.00 mm at 0.25 mm increments. The sample surface after bend testing was observed under 10× magnification. When the crack length on the sample at the outer bend surface is smaller than 0.5 mm the crack is deemed a "micro crack". A crack larger than 0.5 mm is recognized as a failure. Samples without any visible crack are identified as "passed test".

Chemical Analysis of the Hot Bands

Table 4 shows the chemical compositions of the steels with different Ti, B and Nb contents after hot rolling. Compared with the compositions of ingots (Table 3), there was about 0.03% carbon and 0.001% B loss after hot rolling.

TABLE 4

| ID | Steel | C | Mn | Si | S | P | N | Al | Ti | B | Nb |
|---|---|---|---|---|---|---|---|---|---|---|---|
| 1 | Base (0.25C—1.0Mn—0.2Si) | 0.249 | 0.985 | 0.204 | 0.003 | 0.007 | 0.0047 | 0.034 | | | |
| 2 | Base-0.025Ti | 0.247 | 0.981 | 0.197 | 0.003 | 0.005 | 0.005 | 0.038 | 0.024 | | |
| 3 | Base-0.025Ti—0.001B | 0.254 | 0.996 | 0.201 | 0.003 | 0.005 | 0.0044 | 0.039 | 0.024 | 0.001 | |
| 4 | Base-0.025Ti—0.001B—0.03Nb | 0.251 | 0.988 | 0.201 | 0.003 | 0.005 | 0.0044 | 0.038 | 0.024 | 0.001 | 0.028 |

Microstructure and Tensile Properties of Hot Bands

Figure 11A:
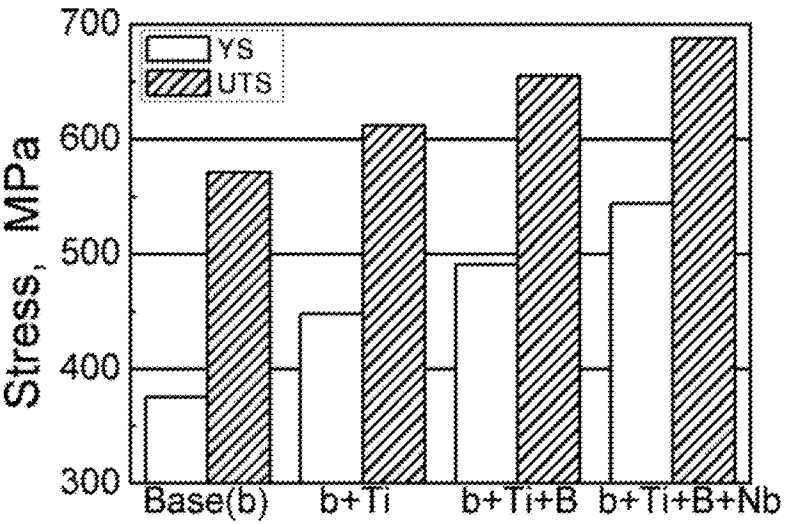
FIGS. 11*a* and 11*b* plot the tensile properties at room temperature of hot bands for producing steels of the present invention, after hot rolling and simulated coiling at 580° C.
Figure 11B:
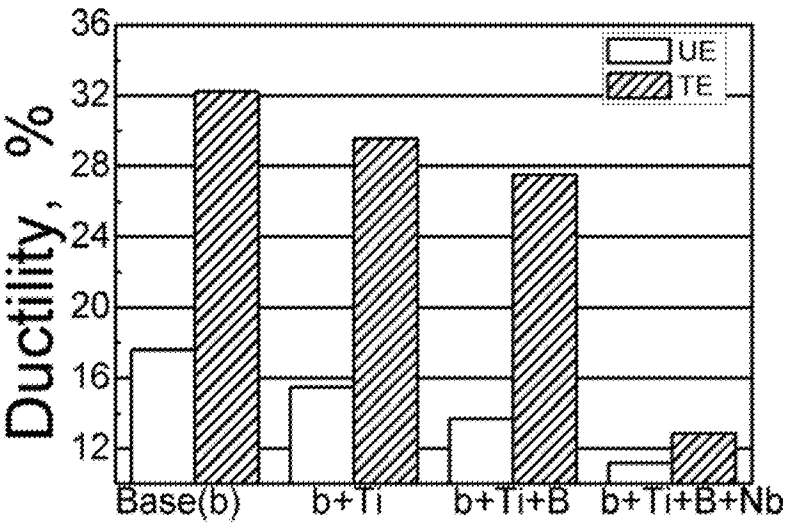

FIGS. 11*a* and 11*b* show the tensile properties (JIS-T standard) of experimental steels (of Table 4) at room temperature, after hot rolling and simulated coiling at 580° C. The base composition consists of 0.28% C-1.0% Mn-0.2% Si. FIG. 11*a* graphically depicts the strength of the four alloys, while FIG. 11*b* plots their ductility. It can be seen that the addition of Ti, B and Nb led to significant increases in the ultimate tensile strength from 571 to 688 MPa yield strength from 375 to 544 MPa, and a decrease in total and uniform elongations (TE: from 32 to 13%; UE: from 17 to 11%). The addition of Nb to the Ti—B steel resulted in a pronounced drop in total elongation from 28 to 13%.

Figure 12A:
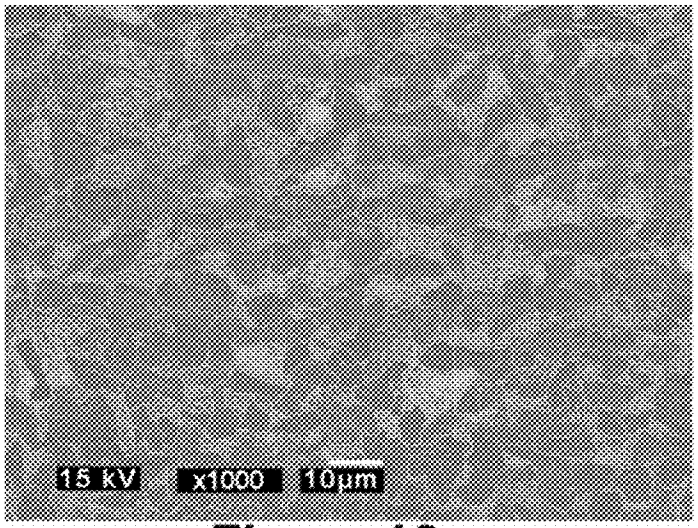
FIGS. 12*a* to 12*d* are SEM micrographs at 1000× of the microstructure of hot band steels after hot rolling and simulated coiling at 660° C.
Figure 12B:
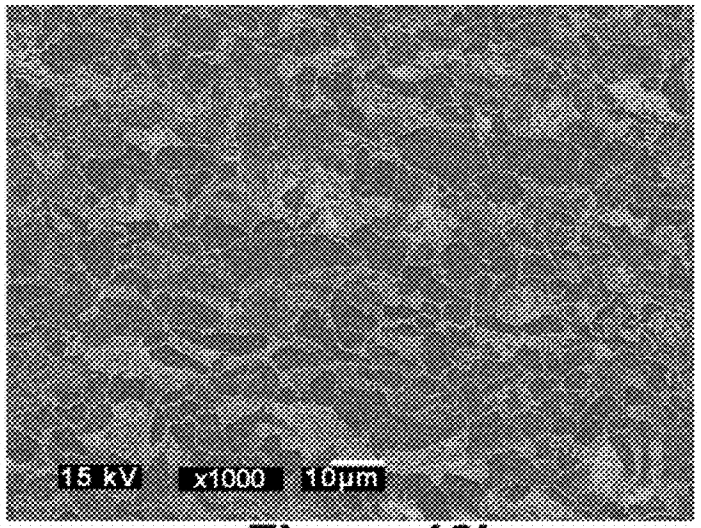
Figure 12C:
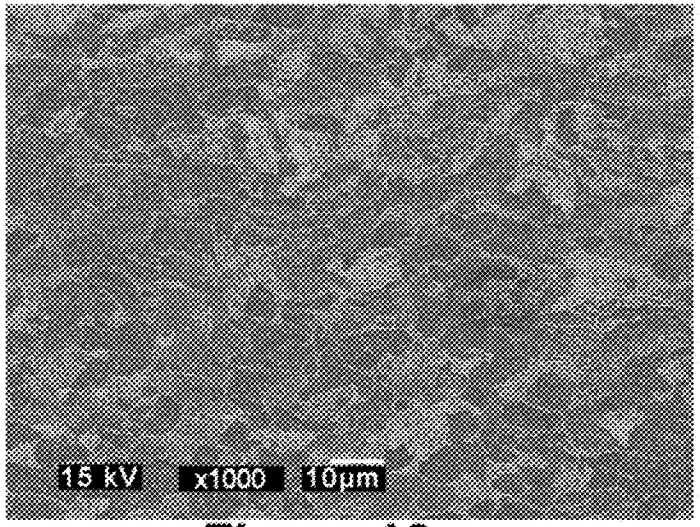
Figure 12D:
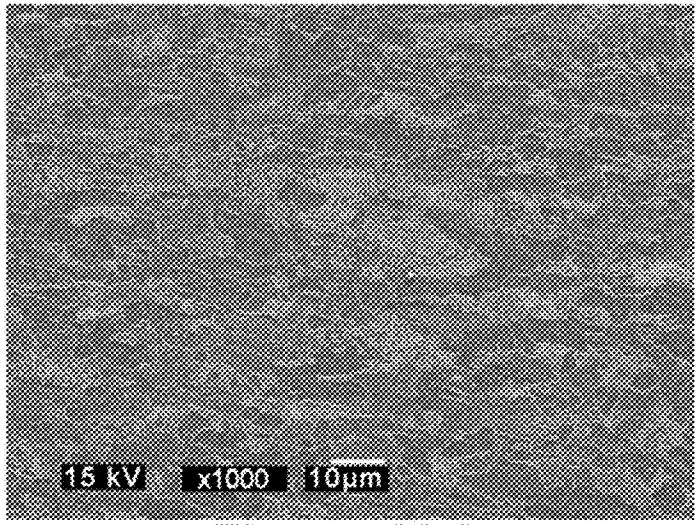

As shown in FIGS. 12*a* to 12*d*, the microstructure of steels after hot rolling and simulated coiling at 660° C. consist of ferrite and pearlite for each laboratory processed experimental steel. FIGS. 12*a* to 12*d* are SEM micrographs at 1000× of the base alloy, base alloy+Ti, base alloy+Ti & B, and base alloy+Ti, B and Nb, respectively. The addition of B seems to result in slightly larger sized pearlite islands (FIG. 12*c*). The ferrite-pearlite microstructure is elongated along the rolling direction in the Nb added steel (FIG. 12*d*), which may be attributed to the Nb addition retarding austenite recrystallization during hot rolling. Thus, the finish rolling occurred in the austenite non-recrystallization region, and the elongated ferrite-pearlite microstructure was transformed directly from the deformed austenite.

Figure 13B:
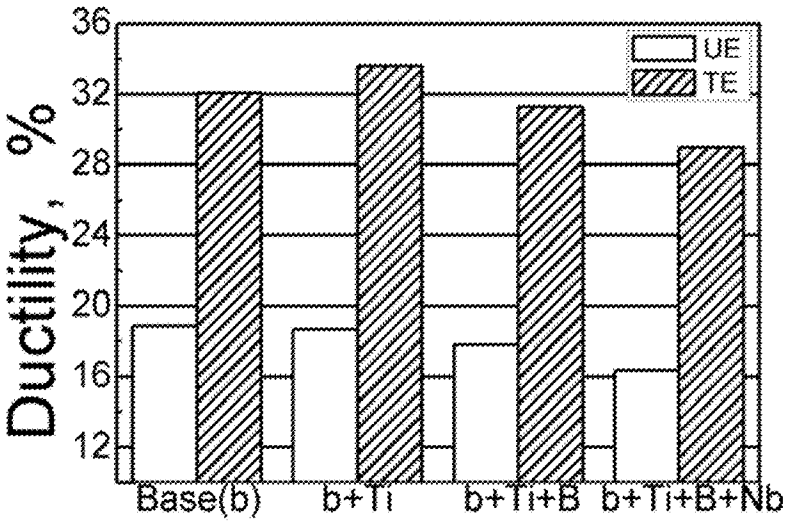
FIGS. 13*a* and 13*b* plot the tensile properties of experimental hot band steels at room temperature.
Figure 13A:
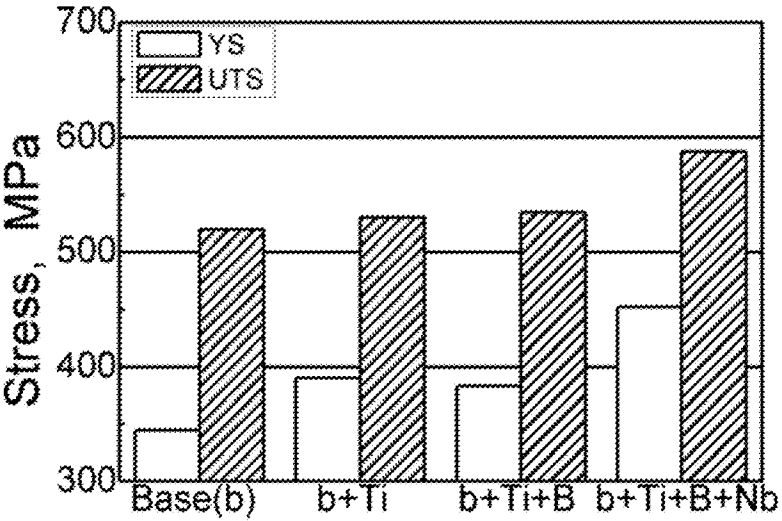

The corresponding tensile properties of the experimental steels at room temperature are shown in FIGS. 13*a* to 13*b*. FIG. 13*a* graphically depicts the strength of the four alloys, while FIG. 13*b* plots their ductility. It can be seen that the addition of Nb (0.03%) led to significant increases in ultimate tensile strength from 535 to 588 MPa and yield strength from 383 to 452 MPa, and slight decreases in total elongation from 31.3 to 29.0% and uniform elongation from 17.8 to 16.4%.

Effect of Coiling Temperature on Tensile Properties

Comparing the tensile properties in FIGS. 11 and 13, the increase in coiling temperature from 580° C. to 660° C. led to a decrease in strength and an increase in ductility, attributes favorable for increased cold reduction possibility and enhanced gauge-width capability. The additions of Ti, B and Nb to the base steel have less of an effect on the tensile properties of the steels at the higher coiling temperature of 660° C. in comparison to 580° C. The purpose of studying the effect of coiling at 660° C. in the laboratory was to understand the effect of coiling temperature on both, hot band strength and the strength of the cold rolled and annealed martensitic steels.

Tensile Properties of the Steels after Annealing Simulation

Figure 14A:
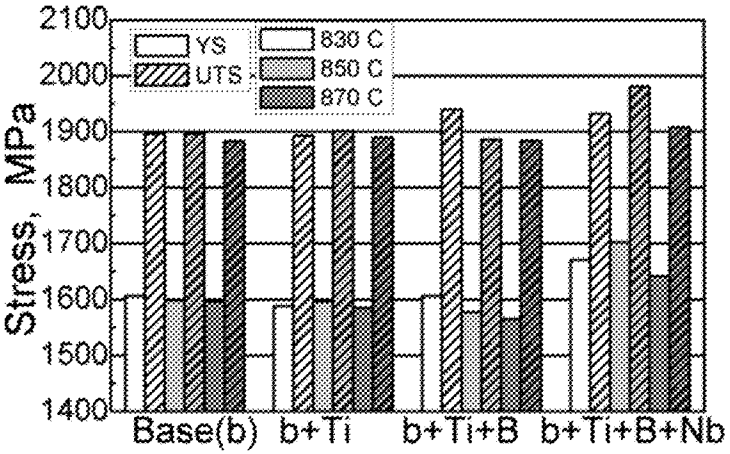
FIGS. 14*a* to 14*d* represent the effects of soaking temperature (830° C., 850° C. and 870° C.), coiling temperature (580° C. and 660° C.), and alloy composition (Ti, B and Nb additions to the base steel) on the tensile properties of the steels after anneal simulation.
Figure 14B:
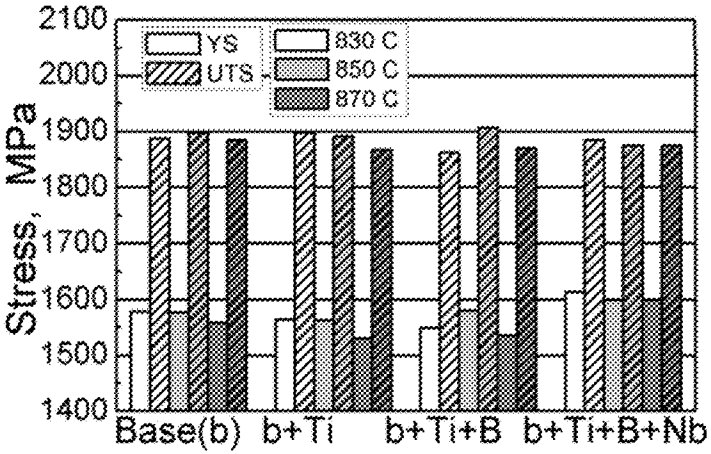
Figure 14C:
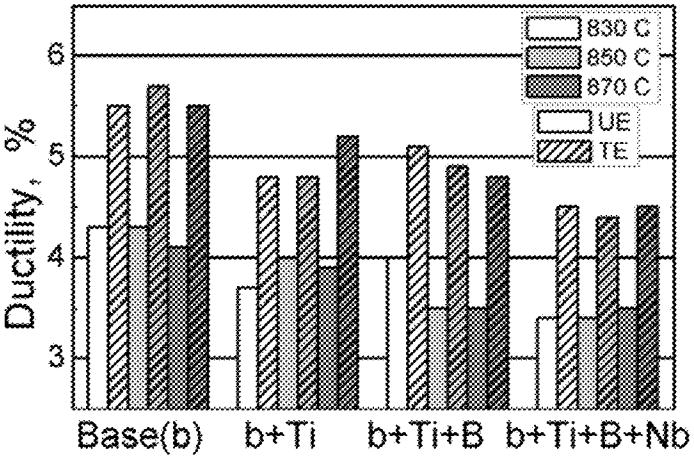
Figure 14D:
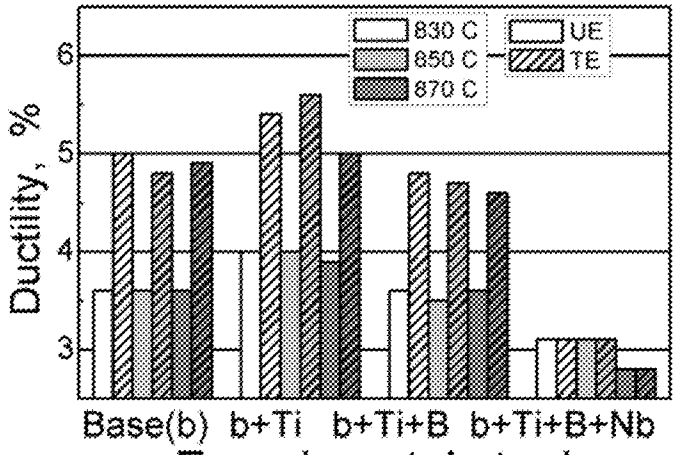

FIGS. 14*a* to 14*d* represent the effects of soaking temperature (830° C., 850° C. and 870° C.), coiling temperature (580° C. and 660° C.), and alloy composition (Ti, B and Nb additions to the base steel) on the tensile properties of the steels after anneal simulation. FIGS. 14*a* and 14*b* plot the strengths of the four alloys at different soaking temperatures and at coiling temperatures of 580° C. and 660° C., respectively. FIGS. 14*c* and 14*d* plot the ductilities of the four alloys at different soaking temperatures and at coiling temperatures of 580° C. and 660° C., respectively. It can be seen that a decrease in the soaking temperature from 870° C. to 830° C. resulted in increases in yield strength of 41 MPa and ultimate tensile strength of 56 MPa for Ti—B steel after hot rolling and simulated coiling at 580° C. (FIG. 14*a*). For Ti—B—Nb steel, after simulated coiling at the same temperature (FIG. 14*a*), the highest strength was represented at the soaking temperature of 850° C. (YS: 1702 MPa and UTS: 1981 MPa). Further increase or decrease of soaking temperature will not improve the strength of Ti—B—Nb steel. The soaking temperature had no obvious effect on the strength for Ti—B of Ti—B—Nb steels after simulated coiling at 660° C. It also had no significant effect on strength for the base and Ti steels at both coiling temperatures, and no effect on ductility for all of the experimental steels.

Figure 15A:
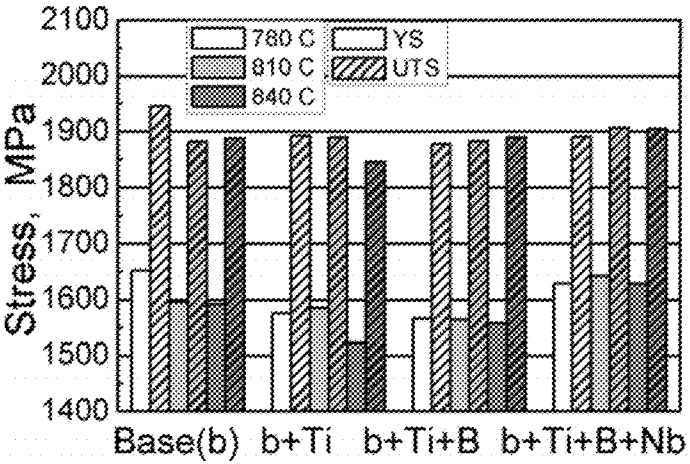
FIGS. 15*a* to 15*d* show the effects of quenching temperature (780° C., 810° C. and 840° C.), coiling temperature (580° C. and 660° C.), and alloy composition (Ti, B and Nb additions to the base steel) on the tensile properties of the steels after anneal simulation.
Figure 15B:
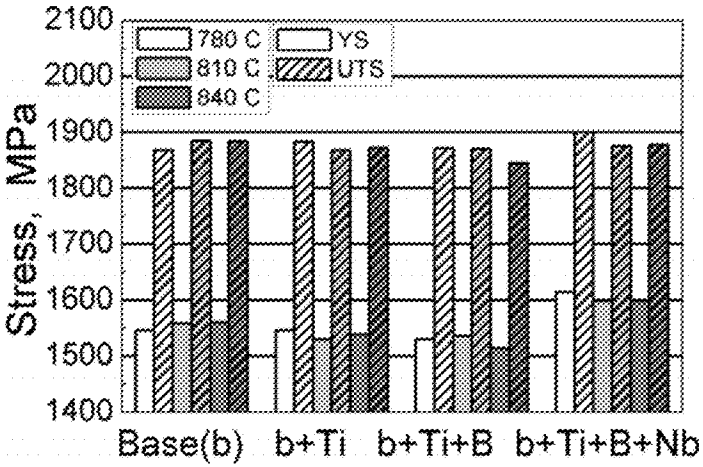
Figure 15C:
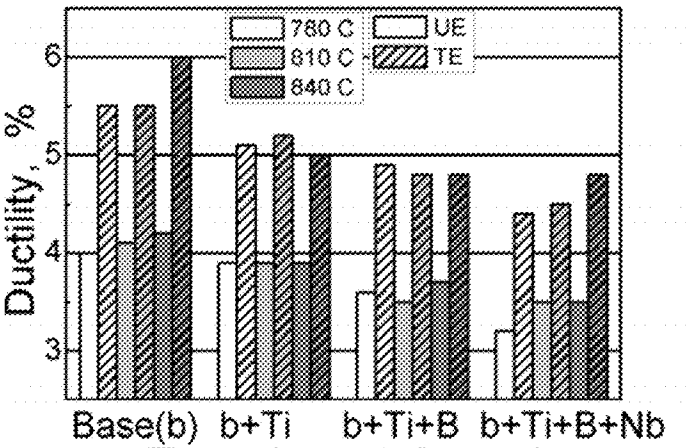
Figure 15D:
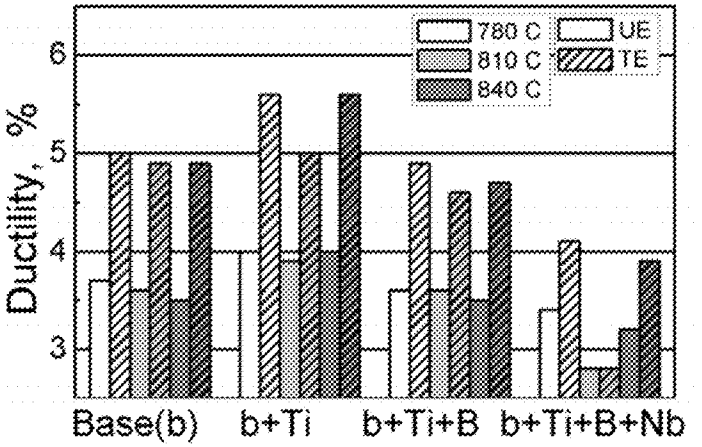

FIGS. 15*a* to 15*d* show the effects of quenching temperature (780° C., 810° C. and 840° C.), coiling temperature (580° C. and 660° C.), and alloy composition (Ti, B and Nb additions to the base steel) on the tensile properties of the steels after anneal simulation. FIGS. 15*a* and 15*b* plot the strengths of the four alloys at different quenching temperatures and at coiling temperatures of 580° C. and 660° C., respectively. FIGS. 15*c* and 15*d* plot the ductilities of the four alloys at different quenching temperatures and at coiling temperatures of 580° C. and 660° C., respectively. A decrease in the quenching temperature from 840° C. to 780° C. resulted in increases in both yield and ultimate tensile strengths of about 50-60 MPa in the base and Ti steels after hot rolling and simulated coiling at 580° C. (FIG. 15*a*). The quenching temperature had no obvious effect on the strength of base and Ti steels after simulated coiling at 660° C. It also had no significant effect on the strength of Ti—B and Ti—B—Nb steels at both coiling temperatures, and on ductility for all of the experimental steels.

Effect of Coiling Temperature (580° C. and 660° C.)

Comparing FIGS. 14*a* and 15*a* with FIGS. 14*b* and 15*b*, the increase in coiling temperature from 580° C. to 660° C. did not lead to a significant change in the tensile strength, but resulted in a slight decrease in the yield strength of about 50 MPa on average for all of the experimental steels at various annealing conditions. Increasing coiling temperature did not have a measurable effect on ductility in the Ti and Ti—B steels, but slightly reduced by about 0.5%, the ductility of the base and Ti—B—Nb steels. These small changes are, however, within the range of test deviation and therefore, not very significant.

Effect of Composition (Ti, B and Nb)

As shown in FIGS. 14*a* to 14*d* and 15*a* to 15*d*, the addition of Ti and B in 0.28% C-1.0% Mn-0.2% Si steel did not have a significant effect on strength at both coiling temperatures of 580° C. and 660° C. The addition of Nb resulted in increases in yield strength of 45-103 MPa and tensile strength of 26-85 MPa at a coiling temperature of 580° C. (FIG. 14*a*), but not for 660° C. (FIG. 14*b*). Except for the Ti added steel which displayed a slightly better ductility at 660° C. coiling temperature (FIGS. 14*d* and 15*d*), alloy additions generally led to a slight decrease in ductility (<1%).

Bendability of the Steels after Anneal Simulation

Table 5 summarizes the effect of Ti, B and Nb on the tensile properties and bendability of the steels after 50% cold rolling and annealing after simulated coiling at 580° C. The annealing process consisted of reheating the cold band (about 1.0 mm thick) to 850° C. for 100 seconds, immediate cooling to 810° C., 40 seconds isothermal hold at "quench" temperature, followed by water quench. The steels were then reheated to 200° C. for 100 seconds followed by air cooling to simulate overaging treatment (OA). As shown, it was possible to produce steels with ultimate tensile strength between 1850 and 2000 MPa by varying alloy composition. The steel with only C, Mn and Si demonstrated the best bendability. The addition of Nb increased strength with a slight deterioration of bendability. Bendability pass defined as "micro crack length smaller than 0.5 mm at 10× magnification.

TABLE 5

| ID | Steel | $T_{soak}$ ° C. | $T_{quench}$ ° C. | $T_{OA}$ ° C. | Gauge mm | YPE % | YS MPa | UTS MPa | YS/UTS | UE % | TE % | Bendability pass |
|---|---|---|---|---|---|---|---|---|---|---|---|---|
| 1 | Base (0.28C—1.0Mn—0.2Si) | 850 | 810 | 200 | 1.03 | 0 | 1599 | 1896 | 0.84 | 4.3 | 5.7 | 3.5t |
| 2 | Base-0.025Ti | 850 | 810 | 200 | 0.99 | 0 | 1597 | 1901 | 0.84 | 4 | 4.8 | >4.0t |
| 3 | Base-0.025Ti—0.001B | 850 | 810 | 200 | 1 | 0 | 1578 | 1886 | 0.84 | 3.5 | 4.9 | 3.75t |
| 4 | Base-0.025Ti—0.001B—0.03Nb | 850 | 810 | 200 | 0.99 | 0 | 1702 | 1981 | 0.86 | 3.4 | 4.4 | >4.0t |

Comparison with Example 1—Effect of Manganese

The steel with 0.28% C-2.0% Mn-0.2% Si was presented in Example 1 above. We can compare its behavior with the steel of Example 2 containing 0.28% C-1.0% Mn-0.2% Si to investigate the effect of Mn (1.0 and 2.0%) on tensile properties. The detailed chemical compositions of both steels are shown in Table 6.

TABLE 6

| Steel | C | Mn | Si | S | P | N | Al |
|---|---|---|---|---|---|---|---|
| Example 1 (0.28C—1.0Mn—0.2Si) | 0.249 | 0.985 | 0.204 | 0.003 | 0.007 | 0.0047 | 0.034 |
| Example 2 (0.28C—2.0Mn—0.2Si) | 0.25 | 2.01 | 0.202 | 0.003 | 0.007 | 0.0045 | 0.032 |

Tensile Properties of Hot Rolled Bands with 1.0 and 2.0% Mn

Table 7 displays the tensile properties of the steels with 1.0% and 2.0% Mn respectively after hot rolling and simulated coiling at 580° C. For the tensile properties of hot rolled bands, the steel with the lower Mn content showed a lower strength than the steel with the higher Mn content (51 MPa lower in YS and 61 MPa lower in UTS). This may facilitate a higher extent of cold rolling for the low Mn steel.

TABLE 7

| Steel | Gauge, mm | YPE, % | YS, MPa | UTS, MPa | YS/UTS | UE, % | TE, % |
|---|---|---|---|---|---|---|---|
| 0.28C—1.0Mn—0.2Si | 3.44 | 1.68 | 375 | 571 | 0.66 | 17.6 | 32.2 |
| 0.28C—2.0Mn—0.2Si | 3.67 | 1.82 | 426 | 632 | 0.67 | 11.3 | 15.8 |

Table 8 shows the tensile properties of the steels with 1.0% and 2.0% Mn respectively after cold rolling (50% cold rolling reduction for the steel with 1.0% Mn and 75% cold rolling reduction for the steel with 2.0% Mn) and various annealing cycles. It can be seen that at the same annealing treatment of 870° C. (soaking), 840° C. (quench) and 200° C. (overaging), Mn content had no significant effect on strength. At the same quenching temperature of 810° C., the decrease in soaking temperature from 870 to 830° C. did not affect the strength of the steel with 1.0% Mn, but significantly increased the strength of the steel with 2.0% Mn by about 90 MPa. This indicates that the steel with 1.0% Mn is quite stable in strength regardless soaking temperature (870 to 830° C.), and the steel with 2.0% Mn is more sensitive to the soaking temperature, perhaps due to grain coarsening at higher anneal temperatures. The steel with 1.0% Mn will be relatively easier to process during manufacturing due to the wider process windows.

TABLE 8

| | Gauge | $T_{Soak}$ ° C. | | $T_{Quench}$ ° C. | | $T_{OA}$ ° C. | | | YS | TS | | | |
|---|---|---|---|---|---|---|---|---|---|---|---|---|---|
| Steel | mm | 100 s | 60 s | 40 s | 25 s | 100 s | 60 s | YPE % | MPa | MPa | YS/UTS | UE % | TE % |
| 0.28 C | 1.03 | 870 | | 840 | | 200 | | 0 | 1593 | 1888 | 0.84 | 4.2 | 6 |
| 1.0 Mn | 1.03 | 870 | | 810 | | 200 | | 0 | 1597 | 1882 | 0.85 | 4.1 | 5.5 |
| 0.2 Si | 0.95 | 870 | | 780 | | 200 | | 0 | 1652 | 1945 | 0.85 | 4 | 5.5 |
| | 1.03 | 850 | | 810 | | 200 | | 0 | 1599 | 1896 | 0.84 | 4.3 | 5.7 |
| | 1.03 | 830 | | 810 | | 200 | | 0 | 1606 | 1896 | 0.85 | 4.3 | 5.5 |
| 0.28 C | 0.68 | | 870 | | 840 | | 200 | 0 | 1589 | 1891 | 0.84 | 3.8 | 3.8 |
| 2.0 Mn | 0.68 | | 870 | | 810 | | 200 | 0 | 1581 | 1927 | 0.82 | 4.3 | 4.3 |
| 0.2 Si | 0.68 | | 870 | | 780 | | 200 | 0 | 1558 | 1907 | 0.82 | 4.5 | 5.4 |
| | 0.69 | | 850 | | 810 | | 200 | 0 | 1657 | 2023 | 0.82 | 3.6 | 3.6 |
| | 0.69 | | 830 | | 810 | | 200 | 0 | 1656 | 2019 | 0.82 | 3.4 | 4.4 |

Bendability of Annealed Steels with 1.0 and 2.0% Mn

Table 9 lists the tensile properties and bendability of the steels with 1.0% and 2.0% Mn after anneal simulation. The steel with 1.0% Mn demonstrated a better bendability (3.5t compared to 4.0t) at a comparable strength level. Bendability pass is defined as micro crack length smaller than 0.5 mm at 10× magnification.

TABLE 9

| Steel | Gauge mm | $T_{Soak}$ ° C. | $T_{GJC}$ ° C. | $T_{OA}$ ° C. | YPE % | YS MPa | TS MPa | YS/UTS | UE % | TE % | Bendability pass |
|---|---|---|---|---|---|---|---|---|---|---|---|
| 0.28C—1.0Mn—0.2Si | 1.03 | 850 | 810 | 200 | 0 | 1599 | 1896 | 0.84 | 4.3 | 5.7 | 3.5t |
| 0.28C—2.0Mn—0.2Si | 0.68 | 870 | 810 | 200 | 0 | 1581 | 1927 | 0.82 | 4.3 | 4.3 | 4.0t |

Example 3

To ensure good weldability of the steels, the carbon equivalent ($C_{eq}$) should be less than 0.44. The carbon equivalent for the present steels is defined as:

$$C_{eq}=C+Mn/6+(Cr+Mo+V)/5+(Ni+Cu)/15.$$

Thus, at a C content of 0.28 wt % and Mn content of 1 or 2 wt %, the weld integrity is determined to be unacceptable. The present examples are designed to reduce the Ceq and still meet the strength and ductility needs. High carbon content is beneficial for increasing strength but deteriorates weldability. According to the carbon equivalent formula, Mn is another element which deteriorates weldability. Thus, the motivation is to maintain a certain amount of carbon content (at least 0.28%) to achieve sufficient ultra-high strength and to study the effect of Mn content on UTS. The inventors look to reduce Mn content to improve the weldability but still maintain an ultra-high strength level.

Heat Preparation

Table 10 shows the chemical compositions of investigated steels in Example 3. The alloy design incorporated the understanding of the effect of C content and B addition on tensile properties in the final annealed products.

TABLE 10

| No. | ID | C | Mn | Si | Ti | B | Al | N | S | P | $C_{eq}$ |
|---|---|---|---|---|---|---|---|---|---|---|---|
| 1 | 28C | 0.282 | 0.577 | 0.199 | 0.021 | | 0.02 | 0.004 | 0.005 | 0.004 | 0.38 |
| 2 | 28C—2B | 0.281 | 0.58 | 0.197 | 0.022 | 0.0016 | 0.022 | 0.0042 | 0.004 | 0.004 | 0.38 |
| 3 | 32C | 0.321 | 0.578 | 0.195 | 0.021 | | 0.021 | 0.0044 | 0.004 | 0.004 | 0.42 |
| 4 | 32C—2B | 0.323 | 0.578 | 0.196 | 0.022 | 0.0017 | 0.032 | 0.0053 | 0.004 | 0.005 | 0.42 |
| 5 | 36C | 0.363 | 0.58 | 0.196 | 0.022 | | 0.025 | 0.0044 | 0.004 | 0.004 | 0.46 |

Five 45 Kg slabs (one of each alloy) were cast in the laboratory. After reheating and austenitization at 1230° C. for 3 hours, the slabs were hot rolled from 63 mm to 20 mm in thickness on a laboratory mill. The finishing temperature was about 900° C. The plates were air cooled after hot rolling.

Hot Rolling and Microstructure/Tensile Property Investigation

After shearing and reheating the pre-rolled 20 mm thick plates to 1230° C. for 2 hours, the plates were hot rolled from a thickness of 20 mm to 3.5 mm. The finish rolling temperature was about 900° C. After controlled cooling at an average cooling rate of about 45° C./s, the hot bands of each composition were held in a furnace at 580° C. and 660° C. respectively for 1 hour, followed by a 24-hour furnace cooling to simulate industrial coiling process. The use of two different coiling temperatures was designed to understand the available process window during hot rolling for the manufacture of this product.

Three JIS-T standard specimens were prepared from each hot rolled steel (also known as a "hot band") for room temperature tensile tests. Microstructure characterization of hot bands was carried out by Scanning Electron Microscopy (SEM) at the quarter thickness location of longitudinal cross-sections.

Cold Rolling and Annealing Simulation

After grinding both surfaces of the hot rolled bands to remove any decarburized layer, the steels were cold rolled in the laboratory by 50% to obtain full hard steels with final thickness of 1.0 mm for further annealing simulations.

Figure 16B:
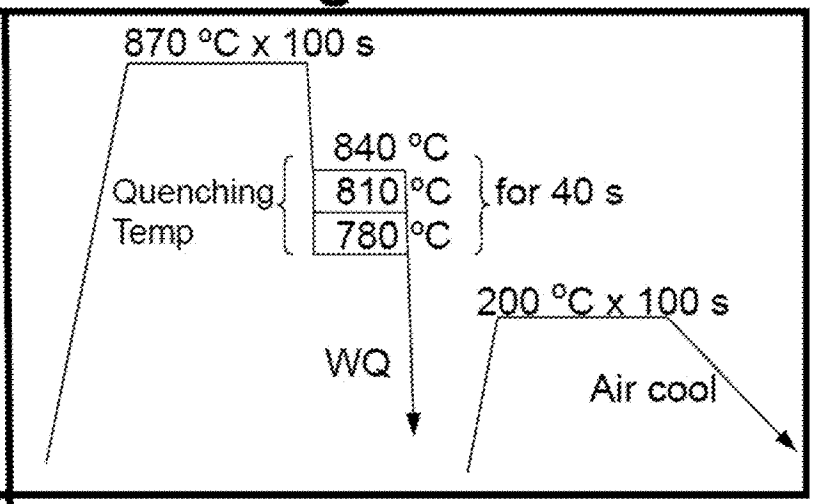
FIGS. 16*a* to 16*c* are even more schematic depictions of anneal cycles for producing the alloys of the present invention.
Figure 16A:
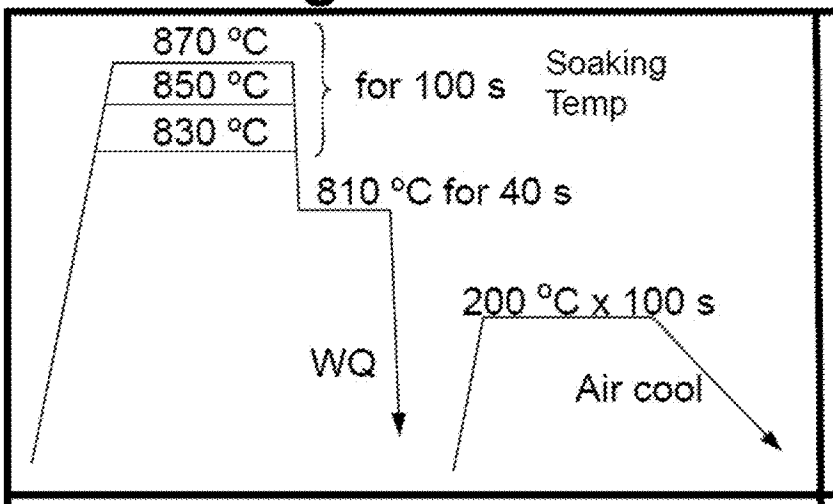
Figure 16C:
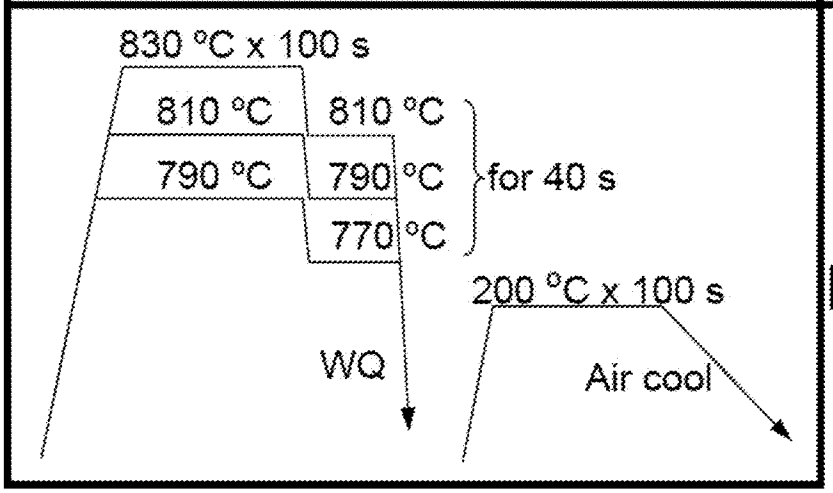

The effects of soaking, quenching temperatures and a comparison of different combination of soaking and quenching temperatures during annealing on the mechanical properties of the steels were investigated for all of the experimental steels. A schematic of the anneal cycles is shown in FIGS. 16*a* to 16*c*. FIG. 16*a* depicts the anneal cycle with varied soaking temperature from 830° C. to 870° C. FIG. 16*b* depicts the anneal cycle with varied quenching temperature from 780° C. to 840° C. FIG. 16*c* depicts the anneal cycle with varied combinations of soaking and quenching temperatures.

Effect of Soaking Temperature

The annealing process includes reheating the cold band (about 1.0 mm thick) to 870° C., 850° C. and 830° C. for 100 seconds, respectively, to investigate the effect of soaking temperature on the final properties. After immediate cooling to 810° C. and isothermal holding for 40 seconds, water quench was applied. The steels were then reheated to 200° C. for 100 seconds, followed by air cooling to simulate overaging treatment.

Effect of Quenching Temperature

The annealing process includes reheating the cold band to 870° C. for 100 seconds and immediate cooling to 840° C., 810° C. and 780° C. respectively to investigate the effect of quenching temperature on the mechanical properties of the steels. Water quench was employed after 40 seconds of isothermal hold at the quenching temperature. The steels were then reheated to 200° C. for 100 seconds, followed by air cooling to simulate overaging treatment.

Effect of the Different Combination of Annealing Cycle

The annealing cycle includes reheating the cold rolled steels to 790° C., 810° C. and 830° C. for 100 seconds respectively, immediate cooling to various quench temperatures (770° C., 790° C. and 810° C. respectively), isothermal holding for 40 seconds, followed by water quench. The steels were then reheated to 200° C. for 100 seconds, followed by air cooling to simulate overaging treatment.

Tensile Property and Bendability of Annealed Steels

ASTM-T standard tensile specimens were prepared from each annealed band for room temperature tensile test. The samples processed by one annealing cycle were selected for bend testing. This annealing cycle involved the reheating of the cold band (about 1.0 mm thick) to 850° C. for 100 seconds, immediate cooling to 810° C., 40 seconds isothermal hold at the quench temperature, followed by water quench. The steels were then reheated to 200° C. for 100 seconds, followed by air cooling to simulate overaging treatment. A 90° free V-bend test along the rolling direction was employed for bendability characterization. In the present study, the range of die radius varied from 2.75 to 4.00 mm at 0.25 mm increments. The sample surface after bend testing was observed under 10× magnification. A crack length on the sample at the outer bend surface that is smaller than 0.5 mm is considered to be a "micro crack", and a crack larger than 0.5 mm is recognized as a failure. A sample without any length of visible crack is identified as "passed the test".

Microstructure and Tensile Properties of Hot Bands

Figure 17A:
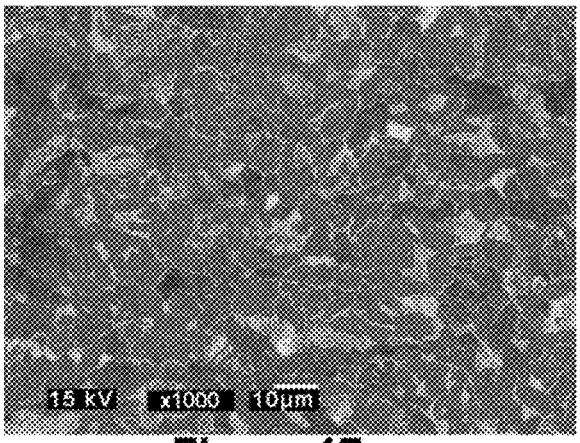
FIG. 17*a* to 17*e* are SEM micrographs at 1,000× of hot rolled steels (0.28 to 0.36% C) after hot rolling and simulated coiling at 580° C.
Figure 17B:
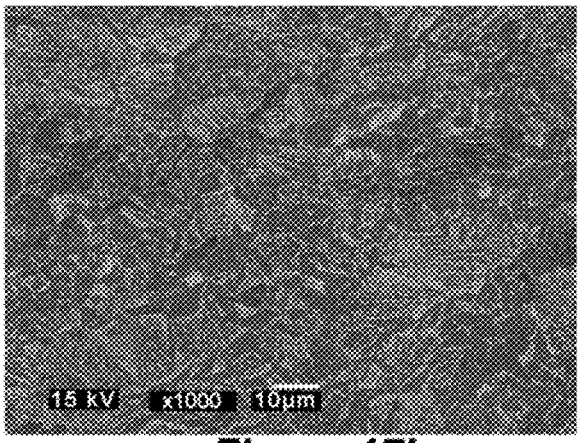
Figure 17C:
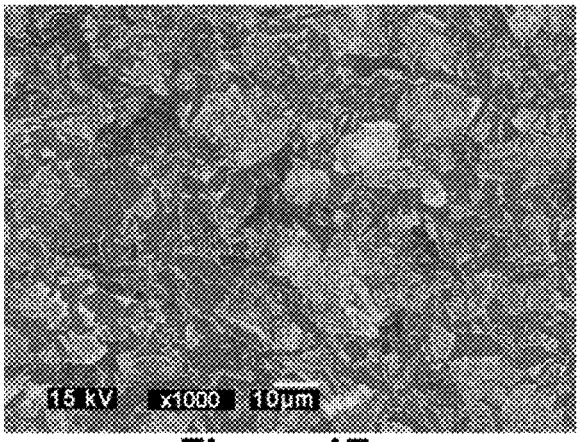
Figure 17D:
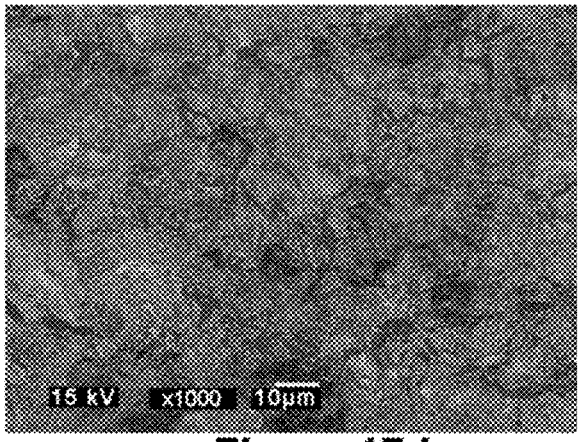
Figure 17E:
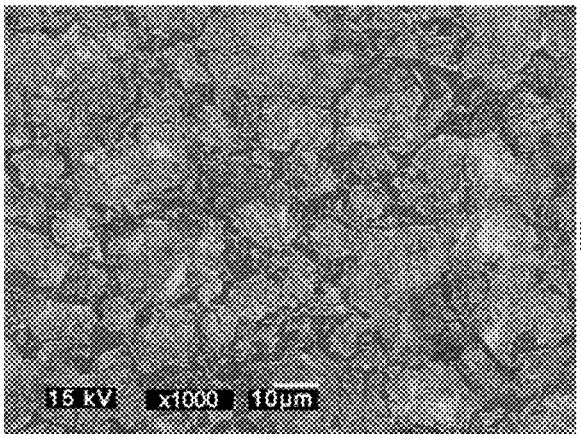

FIG. 17*a* to 17*e* are SEM micrographs at 1,000× of hot rolled steels (0.28 to 0.36% C) after hot rolling and simulated coiling at 580° C. The increase in carbon content and the addition of boron led to an increase in martensite volume fraction, which can be attributed to the role of C and B in increasing hardenability. FIG. 17*a* is an SEM of the steel with 0.28C. FIG. 17*b* is an SEM of the steel with 0.28C-0.002B. FIG. 17*c* is an SEM of the steel with 0.32C. FIG. 17*d* is an SEM of the steel with 0.32C-0.002B. FIG. 17*e* is an SEM of the steel with 0.36C.

Figure 18A:
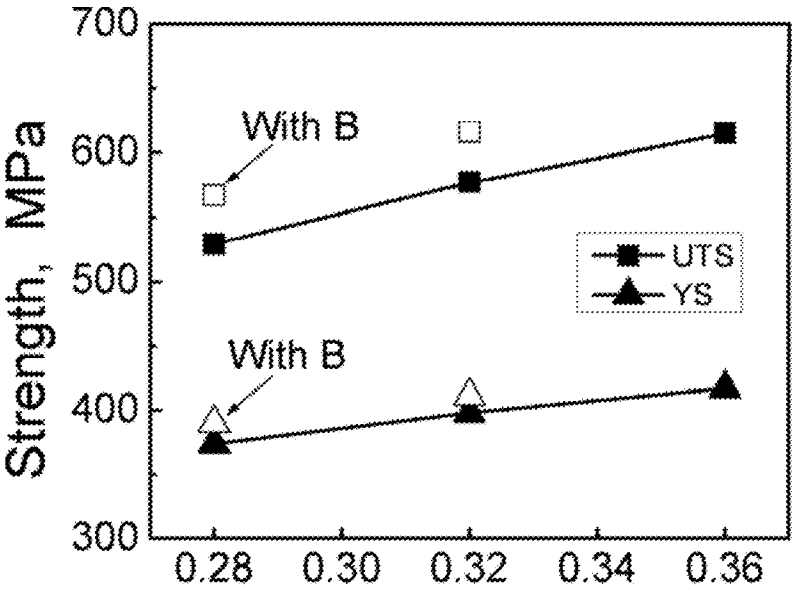
FIGS. 18*a* and 18*b* plot the corresponding tensile properties of the hot rolled steels of FIG. 17*a* to 17*e*, at room temperature (after hot rolling and simulated coiling at 580° C.)
Figure 18B:
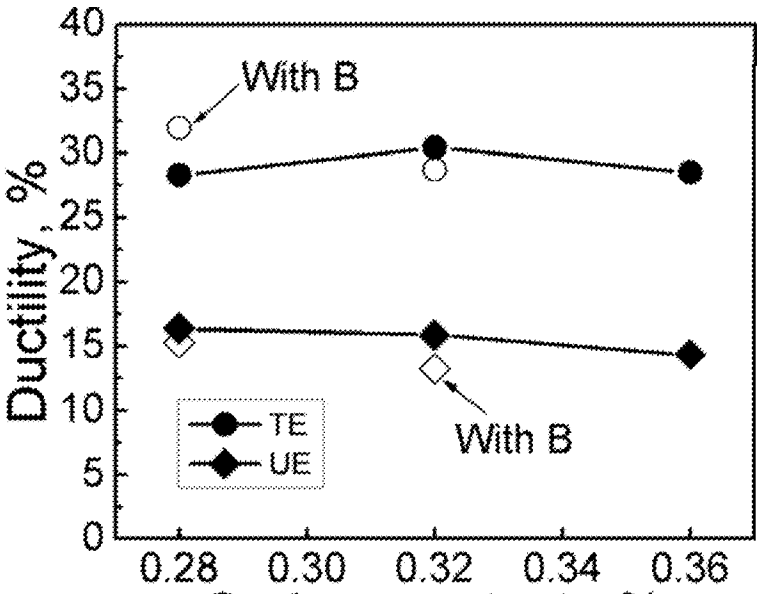

The corresponding tensile properties of the experimental steels at room temperature (after hot rolling and simulated coiling at 580° C.) are shown in FIGS. 18*a* and 18*b*. FIG. 18*a* plots the strength of the alloys versus carbon content, with and without boron. FIG. 18*b* plots the ductility of the alloys versus carbon content, with and without boron. The increase in carbon content from 0.28% to 0.36% led to an increase in ultimate tensile strength from 529 to 615 MPa and yield strength from 374 to 417 MPa. Total and uniform elongations remained similar at 29% and 15%, respectively. The addition of 0.002% boron in 0.28 and 0.32% C steels resulted in an increase in UTS of about 40 MPa.

Figure 19A:
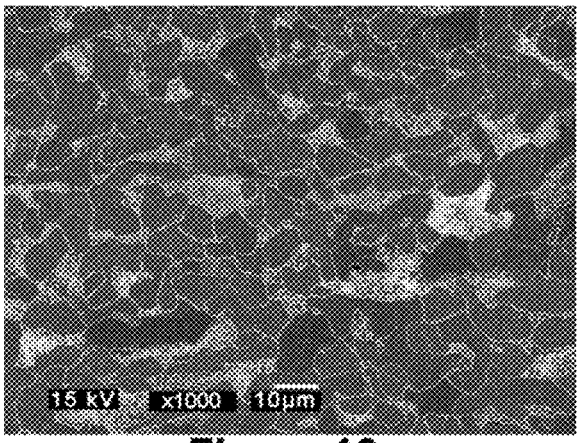
FIG. 19*a* to 19*e* are SEM micrographs at 1,000× of hot rolled steels (0.28 to 0.36% C) after hot rolling and simulated coiling at 660° C.
Figure 19B:
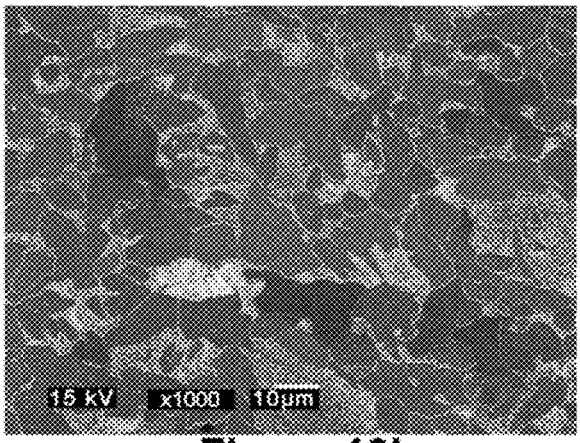
Figure 19C:
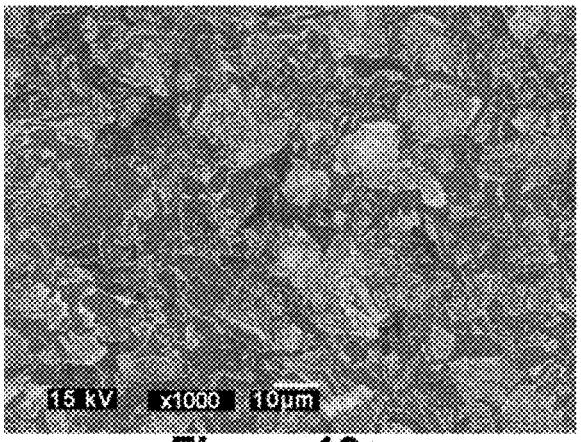
Figure 19D:
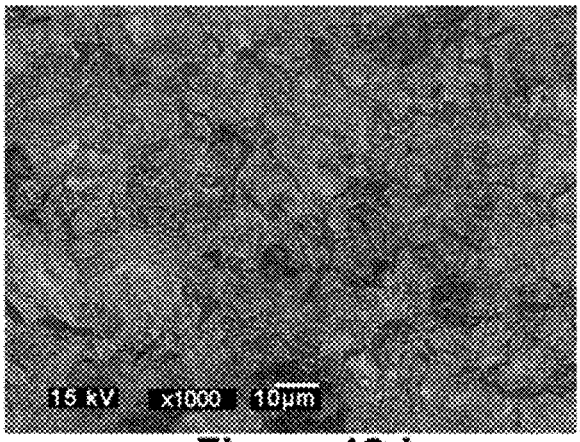
Figure 19E:
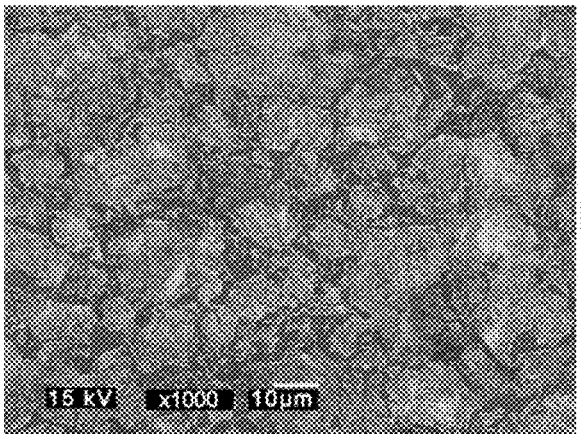

FIG. 19*a* to 19*e* are SEM micrographs at 1,000× of hot rolled steels (0.28 to 0.36% C) after hot rolling and simulated coiling at 660° C. FIG. 19*a* is an SEM of the steel with 0.28C. FIG. 19*b* is an SEM of the steel with 0.28C-0.002B. FIG. 19*c* is an SEM of the steel with 0.32C. FIG. 19*d* is an SEM of the steel with 0.32C-0.002B. FIG. 19*e* is an SEM of the steel with 0.36C. The addition of boron led to a slight grain coarsening, which may be attributed to B retarding phase transformation during cooling. Thus, the finish rolling occurred in the austenite region with relatively coarse austenite grain size for the B added steels, and the coarse austenite transformed directly to a coarse ferrite-pearlite microstructure.

Figure 20B:
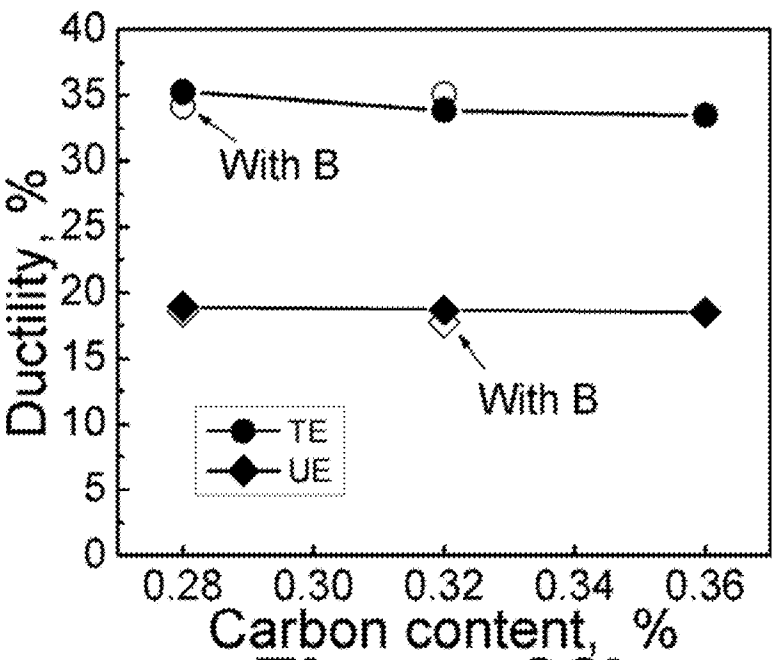
FIGS. 20*a* and 20*b* plot the corresponding tensile properties of the hot rolled steels of FIGS. 19*a* to 19*e*, at room temperature (after hot rolling and simulated coiling at 660° C.)
Figure 20A:
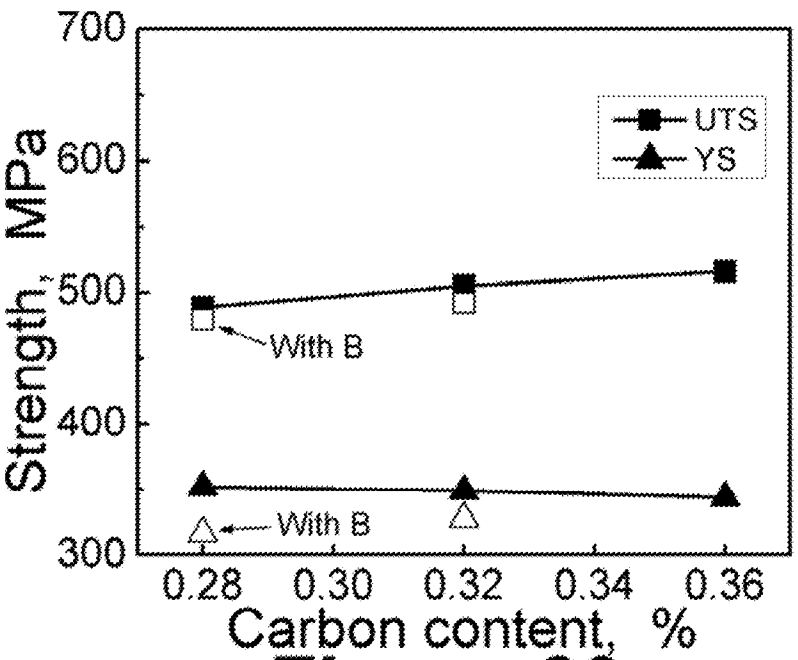

The corresponding tensile properties at room temperature (after hot rolling and simulated coiling at 660° C.) are represented in FIGS. 20*a* and 20*b*. FIG. 20*a* plots the strength of the alloys versus carbon content, with and without boron. FIG. 20*b* plots the ductility of the alloys versus carbon content, with and without boron. The increase in carbon content from 0.28% to 0.36% did not significantly impact tensile properties. The addition of 0.002% boron in 0.28 and 0.32% C steels resulted in a slight decrease in strength, which may be due to grain coarsening. Based on the observed strength levels, the steels should be easily cold rolled to light gauges without any difficulty.

Effect of Coiling Temperature on Tensile Properties

Comparing the tensile properties in FIGS. 18*a* to 18*b* and FIGS. 20*a* to 20*b*, the increase in coiling temperature from 580° C. to 660° C. led to a decrease in strength and an increase in ductility, which attributes favorable the possibility of increased cold reduction and enhanced gauge-width capability. The increase in C content from 0.28% to 0.36% and the addition of B to the base steel have less effect on the tensile properties of the steels at the higher coiling temperature of 660° C. in comparison with 580° C. The purpose of studying the effect of coiling at 660° C. in the laboratory was to understand the effect of coiling temperature on both, hot band strength and the strength of the cold rolled and annealed martensitic steels.

Tensile Properties of the Steels after Annealing Simulation

Effect of Soaking Temperature (830° C., 850° C. and 870° C.)

Figure 21A:
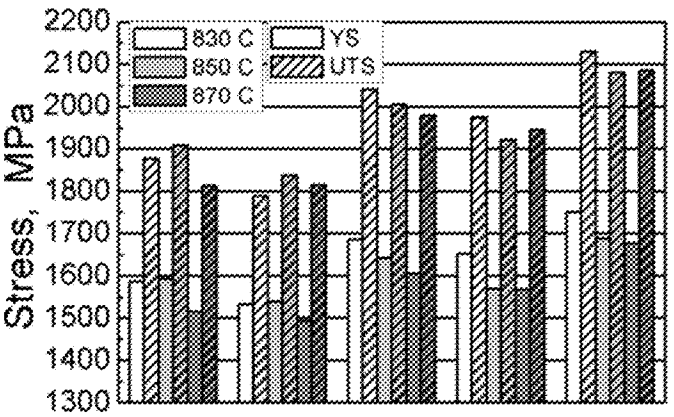
FIGS. 21*a* to 21*d* represents the effects of soaking temperature (830° C., 850° C. and 870° C.), coiling temperature (580° C. and 660° C.), and alloy composition (C content and B addition to the base steel) on the tensile properties of the steels after annealing simulation.
Figure 21B:
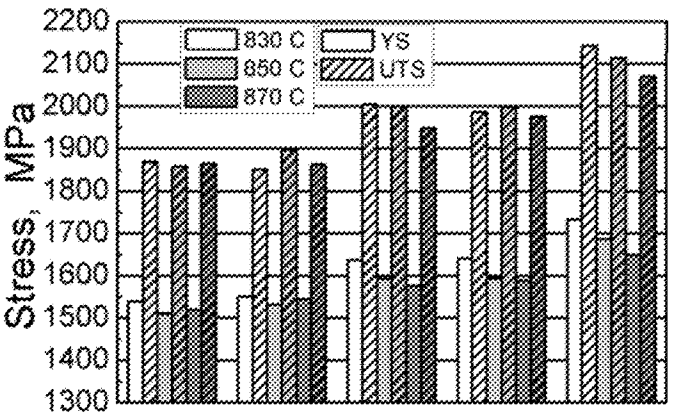
Figure 21C:
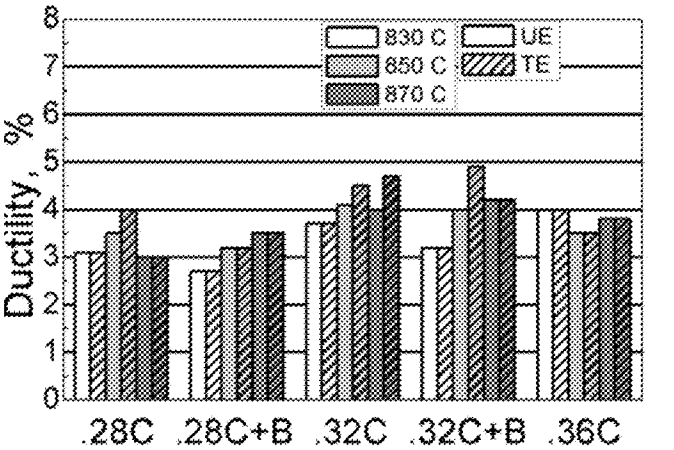
Figure 21D:
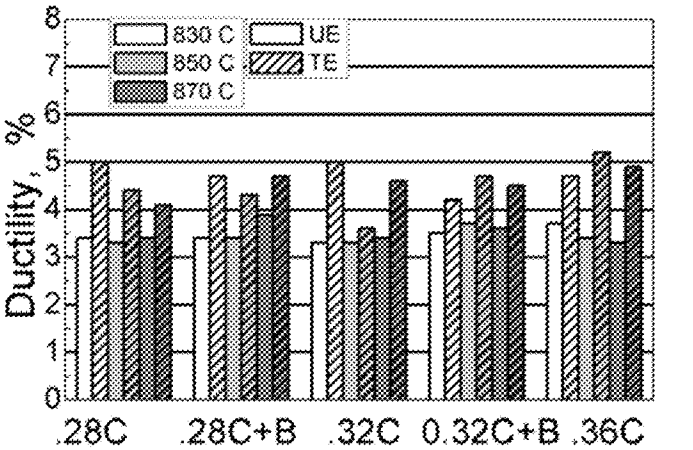

FIGS. 21*a* to 21*d* represents the effects of soaking temperature (830° C., 850° C. and 870° C.), coiling temperature (580° C. and 660° C.), and alloy composition (C content and B addition to the base steel) on the tensile properties of the steels after annealing simulation. FIGS. 21*a* and 21*b* plot the strengths of the five alloys at different soaking temperatures and at coiling temperatures of 580° C. and 660° C., respectively. FIGS. 21*c* and 21*d* plot the ductilities of the five alloys at different soaking temperatures and at coiling temperatures of 580° C. and 660° C., respectively. It can be seen that martensitic steels with UTS level of 2000 to greater than 2100 MPa and TE of 3.5-5.0% can be obtained in the laboratory using the 0.32 and 0.36% C steel compositions at soak temperatures of 830 and 850° C. A decrease in the soaking temperature from 870° C. to 850° C. resulted in a slightly increase in strength for most of the steels. The increase in coiling temperature had no significant effect on strength but slightly improved ductility in most of cases. The increase in C content from 0.28 to 0.36% resulted in an increase in UTS of approximately 200 MPa. The addition of 0.002% B to the base steel led to a decrease in strength for the lower coiling temperature of 580° C. but not for the coiling temperature of 660° C. There was no significant effect of B addition on ductility regardless of coiling temperature.

Effect of Quenching Temperature (780° C., 810° C. and 840° C.)

Figure 22A:
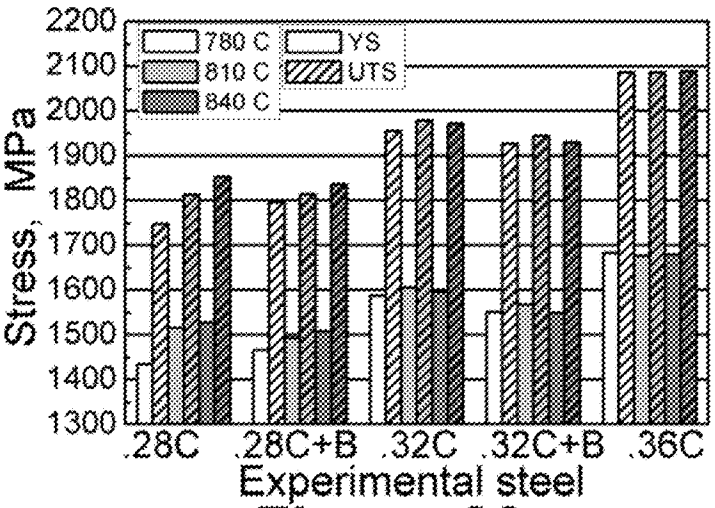
FIGS. 22*a* to 22*d* show the effects of quenching temperature (780° C., 810° C. and 840° C.), coiling temperature (580° C. and 660° C.), and alloy composition (C content and B addition to the base steel) on the tensile properties of the steels after annealing simulation.
Figure 22B:
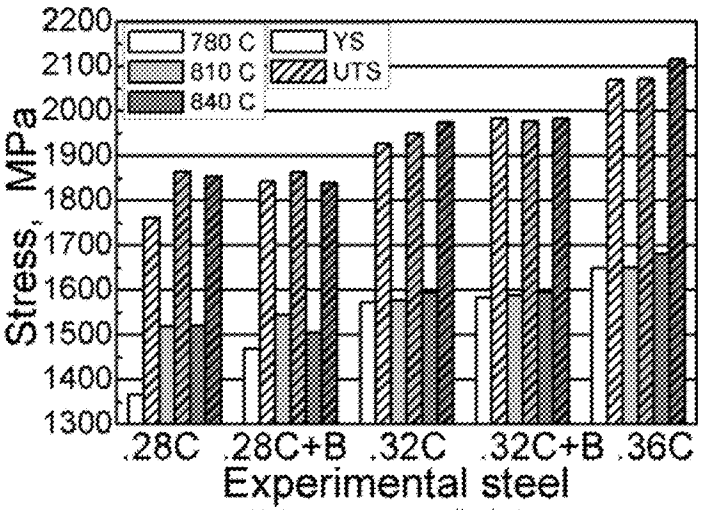
Figure 22C:
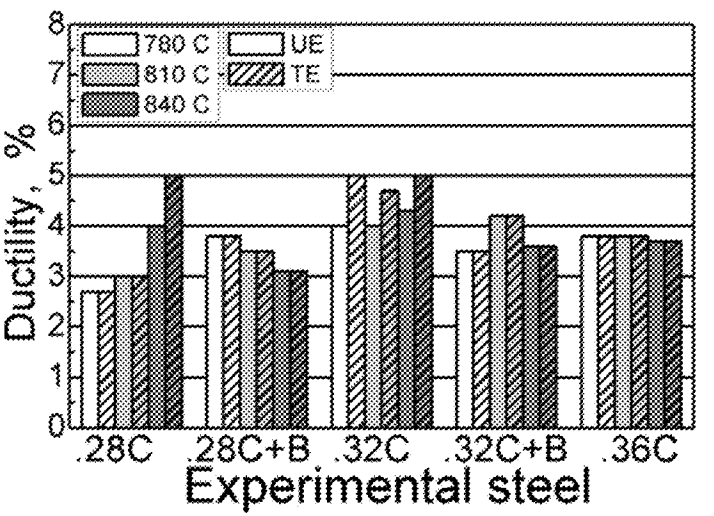
Figure 22D:
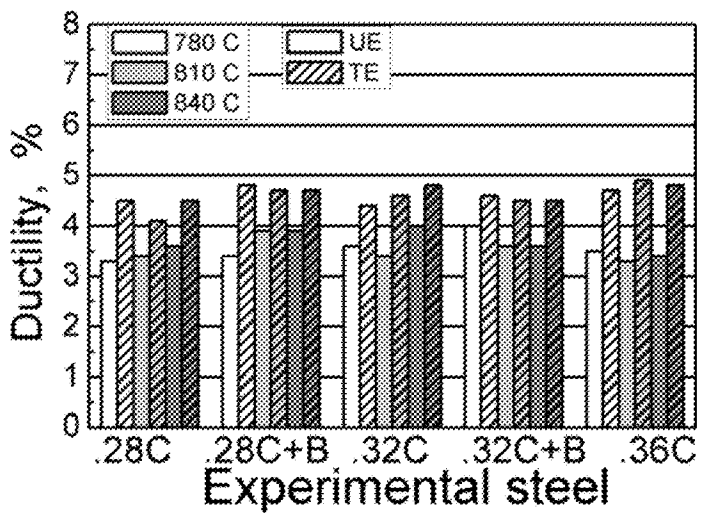
Figure 23A:
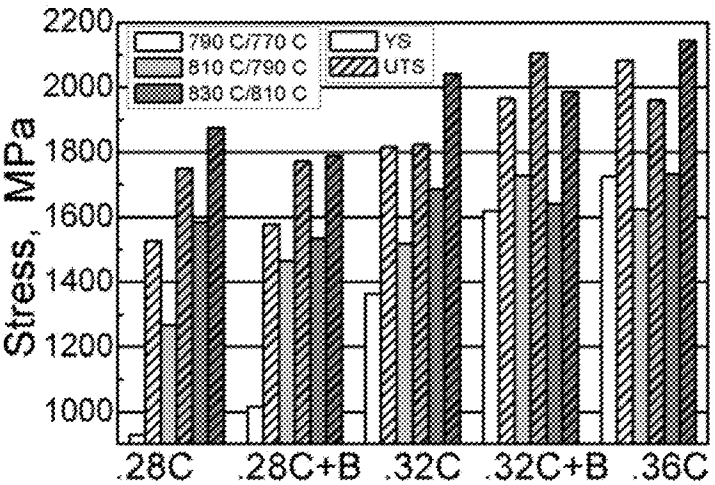
FIGS. 23*a* to 23*d* illustrates the effect of composition and annealing cycle on (23*a*-23*b*) tensile strength and (23*c*-23*d*) ductility.
Figure 23B:
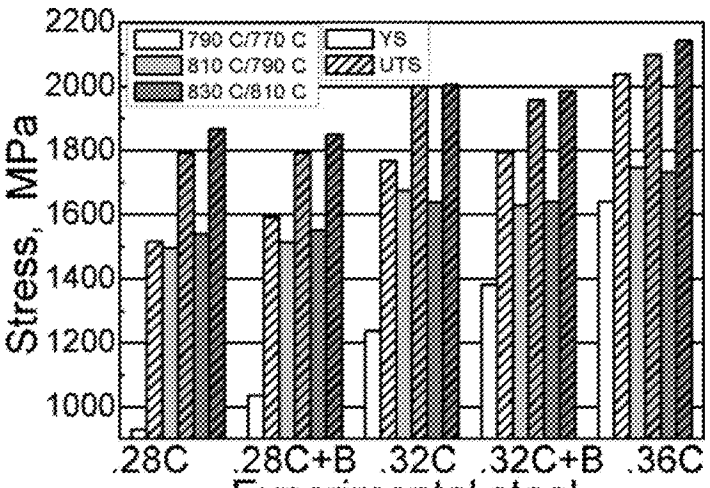
Figure 23C:
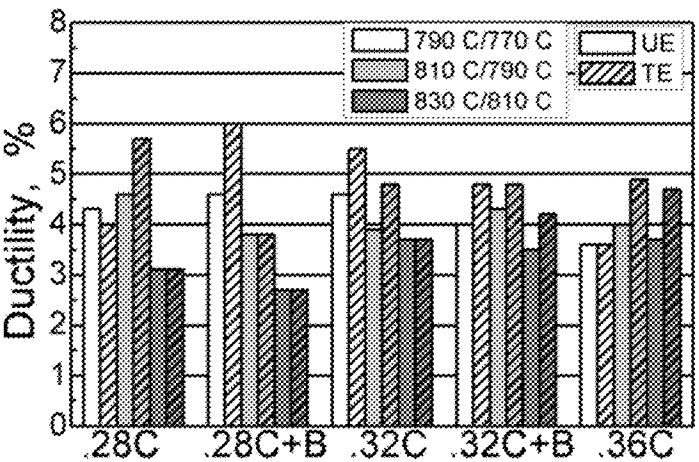
Figure 23D:
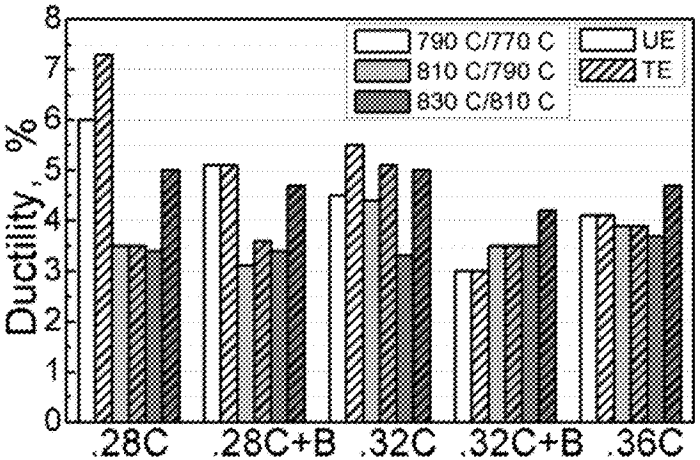
Figure 25A:
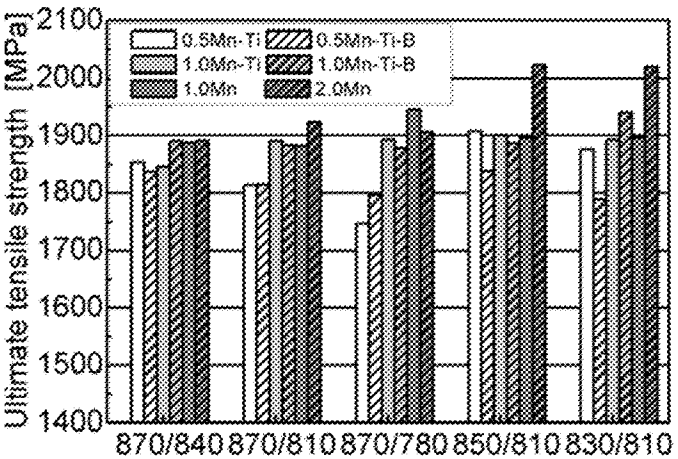
FIGS. 25*a* to 25*d* show the tensile properties of the steels with 0.5% to 2.0% Mn after coiling at 580° C., cold rolling (50% cold rolling reduction for the steel with 0.5 and 1.00/Mn and 75% cold rolling reduction for the steel with 2.00/Mn) and various annealing cycles.
Figure 25B:
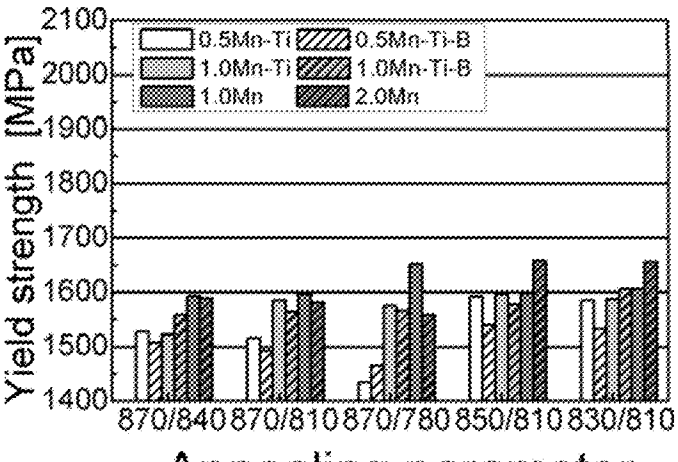
Figure 25C:
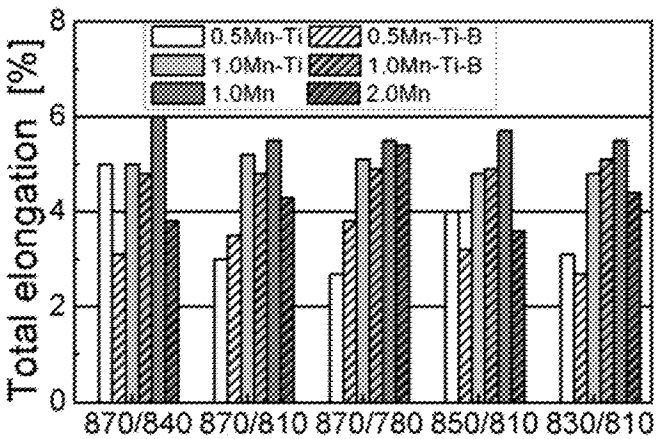
Figure 25D:
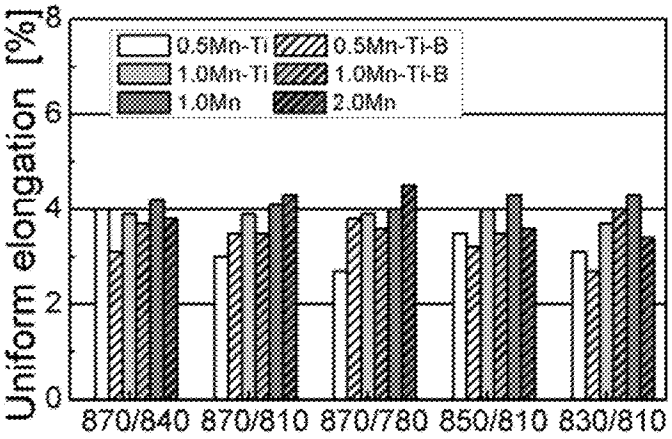

FIGS. 22*a* to 22*d* show the effects of quenching temperature (780° C., 810° C. and 840° C.), coiling temperature (580° C. and 660° C.), and alloy composition (C content and B addition to the base steel) on the tensile properties of the steels after annealing simulation. FIGS. 22*a* and 22*b* plot the strengths of the five alloys at different quenching temperatures and at coiling temperatures of 580° C. and 660° C., respectively. FIGS. 22*c* and 22*d* plot the ductilities of the five alloys at different quenching temperatures and at coiling temperatures of 580° C. and 660° C., respectively. It can be seen that martensitic steels with a UTS close to or exceeding 2100 MPa and a TE of 3.5-5.0% can be obtained in the laboratory using the steel with 0.36% C at the soaking temperature of 870° C. and various quench temperatures. In comparison with the results in FIGS. 21*a* and 21*b*, the steels with not only 0.36% C but also 0.32% C could be heat treated to obtain a UTS level of 2000-2100 MPa and a TE of 3.5-5.0% at soaking temperatures of 830 and 850° C. Thus, a soak temperature of about 850° C. can help to achieve optimal mechanical properties. A decrease in the quenching temperature from 840° C. to 780° C. had no major effect on tensile properties for the steels with 0.32 and 0.36% C regardless of the addition of B and coiling temperature. However, a decrease in the quenching temperature from 840° C. to 780° C. for the steels with 0.28% C (coiling temperature of 580° C.) led to an decrease in strength by 100 MPa when there was no B addition, and this effect became less obvious when there was B addition, i.e. only 40 MPa increase. It demonstrates that B addition is beneficial for the stabilization of tensile properties, especially for the steels with a relatively low C content. The increase in C content from 0.28 to 0.36% resulted in an increase in UTS of approximately 200-300 MPa with no obvious change in ductility especially for the higher coiling temperature of 660° C. Overall, compared to the steels after coiling at 580° C., the tensile properties of the steels coiled at 660° C. had less sensitivity to the quench temperatures.

FIGS. 23*a* to 23*d* illustrates the effect of composition and annealing cycle on (23*a*-23*b*) tensile strength and (23*c*-23*d*) ductility. FIGS. 22*a* and 22*b* plot the strengths of the five alloys at three different soak/quenching temperature pairs (790° C./770° C., 810° C./790° C., and 830° C./810° C.) and at coiling temperatures of 580° C. and 660° C., respectively. FIGS. 22*c* and 22*d* plot the ductilities of the five alloys at the three different soak/quenching temperature pairs and at coiling temperatures of 580° C. and 660° C., respectively. The steels processed at a soak temperature of 790° C. and a quench temperature of 770° C. demonstrated the lowest strength, which can be attributed to the incomplete austenitization at 790° C. soaking temperature. FIGS. 24*a* to 24*d* are micrographs of four of the five alloys which were coiled at 660° C., cold rolled and annealed using the soak/quenching temperature pair 790° C./770° C. As can be seen, ferrite formed after the annealing cycle for all four of the steel compositions. Similarly, FIGS. 24*e* to 24*h* are micrographs of four of the five alloys which were annealed using the soak/quenching temperature pair 810° C./790° C. Ferrite formation can still be observed for the steels with 0.28% C and 0.32% C. The increase in C content resulted in an increase in hardenability so that less ferrite is formed at the same annealing cycle. Finally, FIGS. 24*i* to 24*l* are micrographs of four of the five alloys which were annealed using the soak/quenching temperature pair 830° C./810° C. Most of the steels show the highest strength after annealing at these temperatures, which may be due to the almost fully martensitic microstructure obtained.

Bendability of the Steels after Anneal Simulation

Table 11 summarizes the effects of C and B on the tensile properties and bendability of the steels after 50% cold rolling and annealing after simulated coiling at 580° C. The annealing process consisted of reheating the cold band (about 1.0 mm thick) to 850° C. for 100 seconds, immediate cooling to 810° C., 40 seconds isothermal hold at "quench" temperature, followed by water quench. The steels were then reheated to 200° C. for 100 seconds, followed by air cooling to simulate overaging treatment (OA). As shown in Table 11, it was possible to produce steels with ultimate tensile strength between 1830 and 2080 MPa by varying alloy composition.

TABLE 11

| ID | Steel | $T_{Soak}$ ° C. | $T_{Quench}$ ° C. | $T_{OA}$ ° C. | Gauge mm | YPE % | YS MPa | UTS MPa | YS/UTS | UE % | TE % | Bendability pass |
|---|---|---|---|---|---|---|---|---|---|---|---|---|
| 1 | 28C | 850 | 810 | 200 | 0.93 | 0 | 1593 | 1908 | 0.83 | 3.5 | 4 | 3.5t |
| 2 | 28C—B | 850 | 810 | 200 | 1.06 | 0 | 1540 | 1838 | 0.84 | 3.2 | 3.2 | 3.75t |
| 3 | 32C | 850 | 810 | 200 | 0.99 | 0 | 1644 | 2005 | 0.82 | 4.1 | 4.5 | 4.0t |
| 4 | 32C—2B | 850 | 810 | 200 | 0.99 | 0 | 1569 | 1922 | 0.82 | 4 | 4.9 | 3.5t |
| 5 | 36C | 850 | 810 | 200 | 0.97 | 0 | 1688 | 2080 | 0.81 | 3.5 | 3.5 | 4.0t |

Comparison with Examples 1 and 2—Effect of Manganese for the Steels with 0.28% C The steels with 0.28% C and 1.0%/2.0% Mn were presented above in Examples 1 and 2. We now compare those steels with the steel containing 0.28% C and 0.5% Mn to investigate the effect of Mn (0.5% to 2.0%) on tensile properties. The detailed chemical compositions of the steels are shown in Table 12.

TABLE 12

| No. | ID | C | Mn | Si | Ti | B | Al | N | S | P | Ceq |
|---|---|---|---|---|---|---|---|---|---|---|---|
| 1 | 28C—0.5Mn—Ti | 0.282 | 0.577 | 0.199 | 0.021 | | 0.02 | 0.004 | 0.005 | 0.004 | 0.38 |
| 2 | 28C—0.5Mn—Ti—B | 0.281 | 0.58 | 0.197 | 0.022 | 0.0016 | 0.022 | 0.0042 | 0.004 | 0.004 | 0.38 |
| 3 | 28C—1.0Mn—Ti | 0.28 | 0.98 | 0.198 | 0.024 | | 0.04 | 0.0047 | 0.003 | 0.005 | 0.44 |
| 4 | 28C—1.0Mn—Ti—B | 0.29 | 0.98 | 0.204 | 0.024 | 0.0018 | 0.04 | 0.0047 | 0.003 | 0.005 | 0.45 |
| 5 | 28C—1.0Mn | 0.29 | 0.98 | 0.204 | | | 0.035 | 0.0049 | 0.003 | 0.007 | 0.45 |
| 6 | 28C—2.0Mn | 0.28 | 2.01 | 0.201 | | | 0.034 | 0.005 | 0.003 | 0.006 | 0.62 |

Table 13 displays the tensile properties of the steels with 0.5% to 2.0% Mn and the additions of Ti and B after hot rolling and simulated coiling at 580° C. For the steels with Ti addition, the increase in Mn content from 0.5% to 1.0% led to an increase in both yield and tensile strengths and yield ratio but no significant effect on ductility. The addition of B in Ti added steels with 0.5% to 1.0% Mn resulted in an increase in strength. Compared to the steel "28C-1.0Mn", the addition of Ti was beneficial for increasing both strength and yield ratio, which may be attributed to the effect of Ti precipitation hardening. The steels with the lower Mn content showed a lower strength than the steel with the higher Mn content. This may facilitate a higher extent of cold rolling for the low Mn steel.

TABLE 13

| Steel | Gauge, mm | YPE, % | YS, MPa | UTS, MPa | YS/UTS | UE, % | TE, % |
|---|---|---|---|---|---|---|---|
| 28C—0.5Mn—Ti | 3.89 | 2.15 | 374 | 529 | 0.71 | 16.4 | 29.3 |
| 28C—0.5Mn—Ti—B | 3.77 | 1.7 | 390 | 567 | 0.69 | 15.3 | 32 |
| 28C—1.0Mn—Ti | 3.49 | 3.86 | 448 | 612 | 0.73 | 15.5 | 29.6 |
| 28C—1.0Mn—Ti—B | 3.61 | 3.93 | 491 | 655 | 0.75 | 13.7 | 27.5 |
| 28C—1.0Mn | 3.44 | 1.68 | 375 | 571 | 0.66 | 17.6 | 32.2 |
| 28C—2.0Mn | 3.64 | 1.82 | 426 | 632 | 0.67 | 11.3 | 15.8 |

FIGS. 25*a* to 25*d* show the tensile properties of the steels with 0.5% to 2.0% Mn after coiling at 580° C., cold rolling (50% cold rolling reduction for the steel with 0.5 and 1.0% Mn and 75% cold rolling reduction for the steel with 2.0% Mn) and various annealing cycles. The X-axis of FIGS. 25*a*-25*d* indicates soak and quench temperature, i.e., 870/840 means soaking at 870° C. and quenching at 840° C. It can be seen that at the same annealing treatment of 850° C.-810° C. (soaking-quenching temperature) and 200° C. (overaging), the increase in Mn content from 0.5% to 1.0% had no significant effect on strength for the steel with Ti, but resulted in an increase in strength for the steel with both Ti and B additions and an increase in ductility. The further increase in Mn content to 2.0% led to a pronounced increase in UTS of over 100 MPa, YS of over 50 MPa and a decrease in ductility. This effect was not applicable for high soaking temperature of 870° C., at which the steels with 2.0% Mn did not show an increase in strength. This indicates that the steel with 2.0% Mn is more sensitive to the soaking temperature, which may be due to grain coarsening at higher anneal temperatures. At the soaking temperature of 870° C., the increase in Mn from 0.5% to 1.0% resulted in increases in both strength and ductility for 810° C. and 780° C. quenching temperatures. The steel with 0.5 to 1.0% Mn will be relatively easier to process during manufacturing due to the wider process windows.

Bendability of Annealed Steels with 0.5 to 2.0% Mn (0.28% C)

Table 14 lists the tensile properties and bendability of the steels with 0.5% to 2.0% Mn after anneal simulation, which were previously coiled at 580° C. The steel "28C-0.5Mn—Ti" demonstrated a better bendability than the steel "28C-1.0Mn—Ti" (3.5t compared to 4.0t) at a comparable UTS level of 1900 MPa.

TABLE 14

| Steel | $T_{Soak}$ ° C. | $T_{Quench}$ ° C. | $T_{OA}$ ° C. | Gauge mm | YPE % | YS MPa | UTS MPa | YS/UTS | UE % | TE % | Bendability pass |
|---|---|---|---|---|---|---|---|---|---|---|---|
| 28C—0.5Mn—Ti | 850 | 810 | 200 | 0.93 | 0 | 1593 | 1908 | 0.83 | 3.5 | 4 | 3.5t |
| 28C—0.5Mn—Ti—B | 850 | 810 | 200 | 1.06 | 0 | 1540 | 1838 | 0.84 | 3.2 | 3.2 | 3.75t |
| 28C—1.0Mn—Ti | 850 | 810 | 200 | 0.99 | 0 | 1597 | 1901 | 0.84 | 4 | 4.8 | >4.0t |
| 28C—1.0Mn—Ti—B | 850 | 810 | 200 | 1 | 0 | 1578 | 1886 | 0.84 | 3.5 | 4.9 | 3.75t |
| 28C—1.0Mn | 850 | 810 | 200 | 1.03 | 0 | 1599 | 1896 | 0.84 | 4.3 | 5.7 | 3.5t |
| 28C—2.0Mn | 0.68 | 870 | 810 | 200 | 0 | 1581 | 1927 | 0.82 | 4.3 | 4.3 | 4.0t |

It is to be understood that the disclosure set forth herein is presented in the form of detailed embodiments described for the purpose of making a full and complete disclosure of the present invention, and that such details are not to be interpreted as limiting the true scope of this invention as set forth and defined in the appended claims.

What is claimed is:

1. A martensitic steel alloy consisting of:

C from 0.22 to 0.36 wt. %;

Mn from 0.5% to less than 1% wt. %;

Si from 0% to 0.2%;

Al from 0% to 0.03%;

Ti from 0% to 0.24%;

B from 0% to less than 0.002%;

optionally Nb, N, S, P;

a remainder being iron and unavoidable impurities;

a carbon equivalent $C_{eq}$ of less than 0.44 wherein:

$C_{eq}$=C+Mn/6+(Cr+Mo+V)/5+(Ni+Cu)/15, where $C_{eq}$ is the carbon equivalent, C, Mn, Cr, Mo, V, Ni, and Cu are in wt. % of the elements in the alloy;

an ultimate tensile strength of the alloy being at least 1700 MPa, a total elongation of at least 3.5%.

2. The martensitic steel alloy of claim 1, wherein the alloy has an ultimate tensile strength of at least 1800 MPa.

3. The martensitic steel alloy of claim 2, wherein the alloy has an ultimate tensile strength of at least 1900 MPa.

4. The martensitic steel alloy of claim 3, wherein the alloy has an ultimate tensile strength of at least 2000 MPa.

5. The martensitic steel alloy of claim 4, wherein the alloy has an ultimate tensile strength of at least 2100 MPa.

6. The martensitic steel alloy of claim 1, wherein the alloy has an ultimate tensile strength between 1700 and 2200 MPa.

7. The martensitic steel alloy of claim 1, wherein the alloy has a total elongation of at least 5%.

8. The martensitic steel alloy of claim 1, wherein the alloy is in the form of a cold rolled sheet, band or coil.

9. The martensitic steel alloy of claim 8, wherein the cold rolled sheet, band or coil has a thickness of less than or equal to 1 mm.

10. The martensitic steel alloy of claim 1, wherein said alloy contains 0.2 wt. % silicon.

11. The martensitic steel alloy of claim 1, wherein said alloy further contains one or more of Nb, Ti, B, Al, N, S, P.

12. The martensitic steel alloy of claim 1, wherein C is from 0.28 to 0.36 wt. %.

* * * * *